US009797559B2

(12) United States Patent
Sellam

(10) Patent No.: US 9,797,559 B2
(45) Date of Patent: Oct. 24, 2017

(54) LIGHTING SYSTEM

(71) Applicant: MEDIA GRAPH DEPOT INC., Montreal (CA)

(72) Inventor: David Sellam, Montreal (CA)

(73) Assignee: MEDIA GROUP DEPOT INC., Montreal (CA)

( * ) Notice: Subject to any disclaimer, the term of this patent is extended or adjusted under 35 U.S.C. 154(b) by 30 days.

(21) Appl. No.: 14/419,626

(22) PCT Filed: Oct. 31, 2013

(86) PCT No.: PCT/CA2013/050831

§ 371 (c)(1),
(2) Date: Feb. 4, 2015

(87) PCT Pub. No.: WO2014/067010

PCT Pub. Date: May 8, 2014

(65) Prior Publication Data

US 2015/0226391 A1 Aug. 13, 2015

Related U.S. Application Data

(60) Provisional application No. 61/720,626, filed on Oct. 31, 2012.

(51) Int. Cl.
*F21S 4/00* (2016.01)
*G09F 13/04* (2006.01)
(Continued)

(52) U.S. Cl.
CPC ..... *F21S 4/003* (2013.01); *F21S 4/20* (2016.01); *F21S 8/068* (2013.01); *F21V 19/003* (2013.01);
(Continued)

(58) Field of Classification Search
CPC .... F21V 21/002; F21V 21/005; F21V 21/008; F21V 23/06; F21V 17/08; F21S 4/003
(Continued)

(56) References Cited

U.S. PATENT DOCUMENTS 4,514,791 A 4/1985 Tokieda
4,710,594 A * 12/1987 Walling ..... H01B 13/24 156/51
(Continued)

FOREIGN PATENT DOCUMENTS

CA 2559165 9/2005
EP 0911573 4/1999
(Continued)

*Primary Examiner* — Anh Mai
*Assistant Examiner* — Matthew Peerce
(74) *Attorney, Agent, or Firm* — Leason Ellis LLP

(57) ABSTRACT

There is a provided a lighting system comprising a first cable and a second cable for receiving a voltage difference. The first cable extends between a first pair of installation locations and the second cable extends between a second pair of installation locations. The lighting system also comprises a plurality of light emitting diode (LED) strips, each LED strip electrically connected to and extending between the first cable and second cable. The lighting system also comprises a cable tensioner system coupled to the first cable and second cable for adjusting the tension of the first cable and second cable.

20 Claims, 31 Drawing Sheets

DETAIL A

(51) Int. Cl.

| | |
|---|---|
| ***F21V 19/00*** | (2006.01) |
| ***F21V 23/00*** | (2015.01) |
| ***F21S 4/20*** | (2016.01) |
| ***F21S 8/06*** | (2006.01) |
| *G09F 13/22* | (2006.01) |
| *F21S 2/00* | (2016.01) |
| *F21V 33/00* | (2006.01) |
| *F21Y 105/10* | (2016.01) |
| *F21Y 103/10* | (2016.01) |
| *F21Y 115/10* | (2016.01) |

(52) U.S. Cl.
CPC ..... *F21V 23/002* (2013.01); *G09F 13/04* (2013.01); *F21S 2/00* (2013.01); *F21V 33/006* (2013.01); *F21Y 2103/10* (2016.08); *F21Y 2105/10* (2016.08); *F21Y 2115/10* (2016.08); *G09F 2013/222* (2013.01)

(58) Field of Classification Search
USPC ..... 362/249.02
See application file for complete search history.

(56) References Cited

U.S. PATENT DOCUMENTS 4,837,667 A * 6/1989 Grau ..... F21S 2/00 362/147
5,158,360 A * 10/1992 Banke ..... F21S 8/068 362/391
5,785,411 A 7/1998 Komai et al.
5,962,813 A 10/1999 Shirako et al.
2005/0117339 A1* 6/2005 Pan ..... A47F 11/10 362/249.01
2006/0071510 A1* 4/2006 Jiang ..... A47C 9/06 297/14
2008/0175011 A1 7/2008 Joseph
2008/0205059 A1* 8/2008 Tsuji ..... F21V 21/002 362/249.01
2009/0291587 A1 11/2009 Sato et al.

FOREIGN PATENT DOCUMENTS

| | | |
|---|---|---|
| EP | 19651213 | 9/2008 |
| FR | 2 694 437 | 2/1994 |
| FR | 2 846 401 | 4/2004 |
| GB | 2467799 | 8/2010 |
| JP | 225118 | 2/1990 |
| JP | 10134863 | 5/1998 |
| JP | 200030521 | 1/2000 |
| JP | 2006236877 | 9/2006 |
| JP | 2006236878 | 9/2006 |
| JP | 2007533066 | 11/2007 |
| JP | 2008277195 | 11/2008 |
| JP | 201279539 | 4/2012 |
| JP | 2012164783 | 8/2012 |
| JP | 2012204020 | 10/2012 |
| WO | WO 88/02460 | 4/1988 |
| WO | WO 2009/011853 | 1/2009 |
| WO | WO2011069945 | 6/2011 |
| WO | WO2011089536 | 7/2011 |

* cited by examiner

DETAIL A

DETAIL B

DETAIL C

DETAIL D

LIGHTING SYSTEM

CROSS REFERENCE TO RELATED APPLICATIONS

The present application is a U.S. National Phase of International Patent Application PCT/CA2013/050831, filed Oct. 31, 2013, which claims priority from U.S. Provisional Patent Application Ser. No. 61/720,626 filed on Oct. 31, 2012, the entire contents of which are incorporated herein by reference.

TECHNICAL FIELD

The present invention relates generally to lighting systems, and more specifically, lighting systems comprising light emitting diode (LED) strips.

BACKGROUND

Conventional medium and large sized lighting systems, such as LED light boxes, found in the market can be difficult to transport due to their size, thus increasing transportation complexity and costs, as well as storage space required when the lighting systems are not used. Furthermore, lighting systems may be assembled from many different parts (e.g. over hundreds or thousands of LED strips) that require time-consuming manual effort to position within and attach to other components within the lighting system.

It is an object of the present invention to overcome or mitigate at least one of the above disadvantages. In particular, one object of the present invention is to provide a lighting system which overcomes at least one of the problems associated with known lighting systems.

SUMMARY OF THE INVENTION

In an aspect, there is provided a lighting system, such as a collapsible lighting system, made with a frame of extruded aluminum bars, united together in the corners, including a plurality of LEDs united on a printed circuit board (PCB) strip or LED strip, which are assembled over electrified steel cables, tensioned between opposite sides of the frame.

In an aspect, there is a provided a lighting system comprising a first cable and a second cable for receiving a voltage difference. The first cable extends between a first pair of installation locations and the second cable extends between a second pair of installation locations. The lighting system also comprises a plurality of light emitting diode (LED) strips, each LED strip electrically connected to and extending between the first cable and second cable. The lighting system also comprises a cable tensioner system coupled to the first cable and second cable for adjusting the tension of the first cable and second cable.

In some examples, each LED strip is connected to the first cable using a first connector and connected to the second cable using a second connector. The LED strip may comprise a first indicator for aligning with the first connector and a second indicator for aligning with the second connector. The first indicator may be distinct from the second indicator. The first indicator may comprise a pair of aligned indents along the LED strip and the second indicator may comprise a pair of staggered indents along the LED strip.

In some examples, the LED strips comprise a plurality of contacts connectable to the first connector and second connector. The plurality of LED strips may be detachably connected to the first cable and second cable.

In some examples, at least one of the first cable and second cable comprise a copper core and a plurality of wires having a higher tensile strength than the core. The wire having a higher tensile strength may comprise steel.

In some examples, the cable tensioner system comprises a first cable tensioner at one end of the first cable and a second cable tensioner at one end of the second cable, such that tension of the first cable and second cable may be independently adjusted. The cable tensioner system may further comprise a third cable tensioner at the other end of the first cable and a fourth cable tensioner at the other end of the second cable, such that the tension of the first cable and second cable may be adjusted at both respective ends.

In some examples, the first cable is electrically insulated from the frame and the second cable is electrically coupled to the frame. The first cable may be electrically coupled to a positive terminal of a power supply and the second cable may be electrically coupled to a negative terminal of the power supply.

In some examples, the LED strips may comprise a plurality of LEDs substantially evenly spaced a distance apart along the LED strip and the plurality of LED strips may be substantially evenly spaced a distance apart along the first cable and second cable.

In some examples, the cable tensioner system is detachably coupled to the installation locations.

In some examples, at least one of the cable tensioners is fixed to one of the installation locations using an anchor. The anchor may be conductive. The first cable tensioner may be attached to the anchor and the anchor may be electrically coupled to a positive terminal of a power supply through one or more other anchors electrically connected in series. In some examples, the anchor is slidable along an extruded bracket at the installation location.

In some examples, the first pair of installation locations and second pair of installation locations are parts of a frame. Each of the installation locations of the first pair and each of the installation locations of the second pair may be on opposite sides of the frame.

In some examples, the LED strips face a cover to be illuminated by the LED strips. Each of the LED strips may comprise a plurality of LEDs on opposite sides of the LED strip. The opposite sides of the LED strips may face respective covers to be illuminated by the LED strips. At least one of the covers may comprise any one or more of a banner, a sign, an advertisement and an image.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
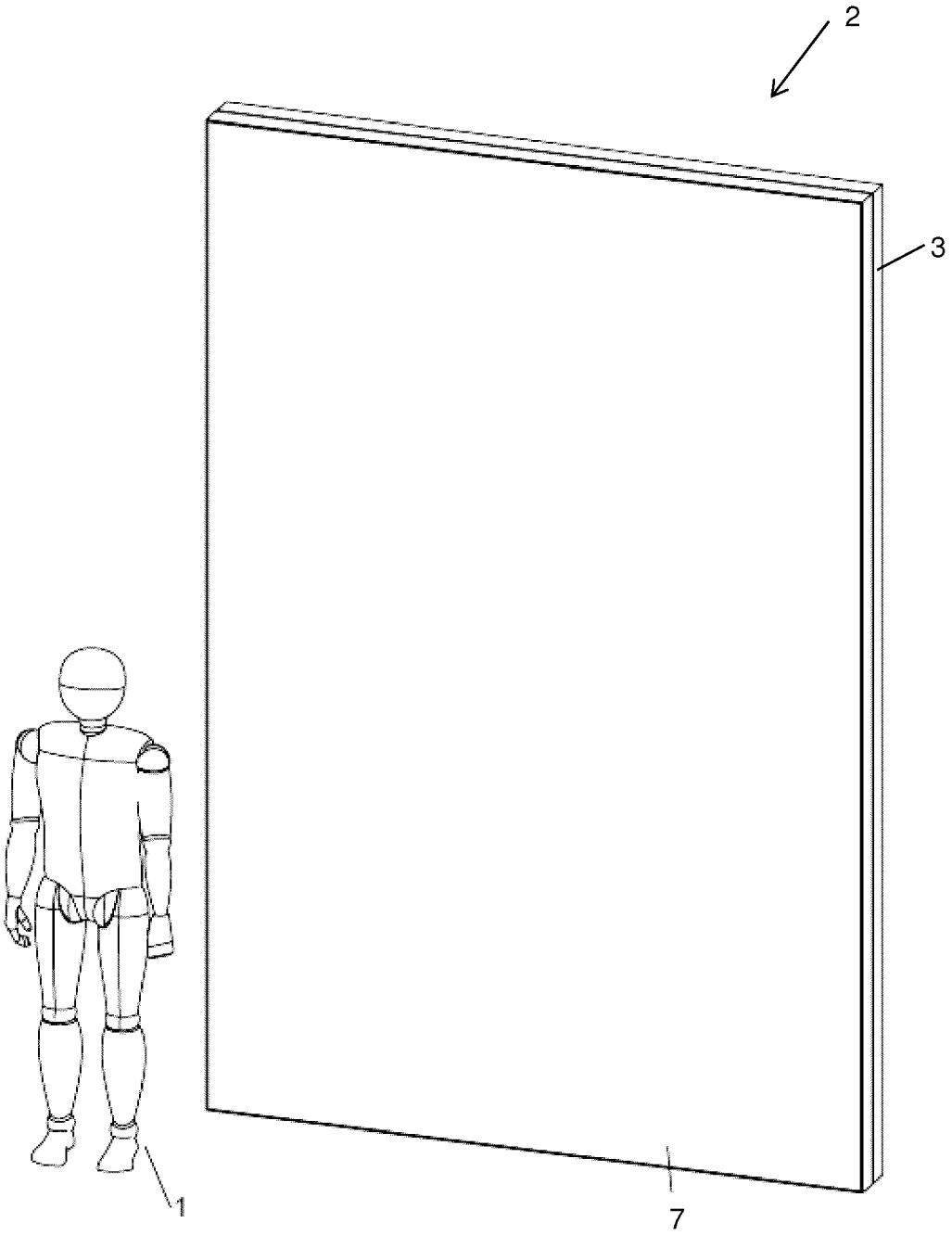
FIG. 1 is a perspective view of an example light box.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details.

In other instances, well-known methods, procedures and components have not been described in detail so as not to obscure the example embodiments described herein. Also, the description is not to be considered as limiting the scope of the example embodiments described herein.

Referring to FIG. 1, a perspective view of an example lighting system 2 used in a light box application is provided. The light box is shown beside a person 1 to provide an example of the relative size of an example medium-sized lighting system 2. It will be appreciated that in other examples, the size of the lighting system 2 can be significantly bigger or smaller than the example lighting system 2 depicted. In this example, the lighting system 2 is used with a frame 3 and a cover 7 mounted along the frame 3. The cover 7 can display a banner, sign, advertisement, image or other content and can be made of any material that can be illuminated by the lighting system 2 behind the cover 7. For example, the cover 7 can be made of fabric with one or more printed images thereon. It will be appreciated that the cover 7 can be mounted on the frame using any suitable means. For example, a strip of silicon can be sewed along the edges of the cover 7 and then inserted into grooves along the frame 3 to hold the banner stretched across and attached to the frame 3.

Figure 2:
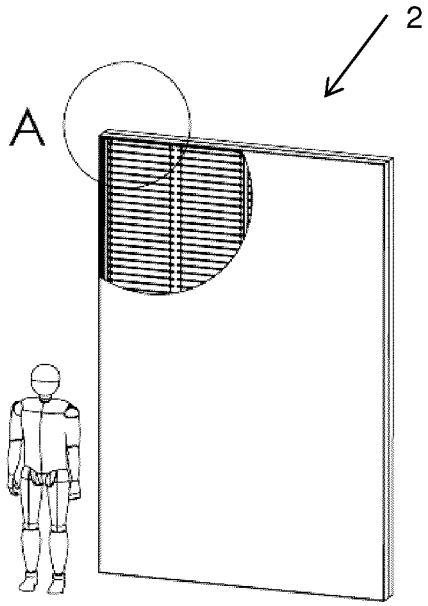
FIG. 2 is cutaway and expanded view of a portion of an example lighting system.
Figure 2:
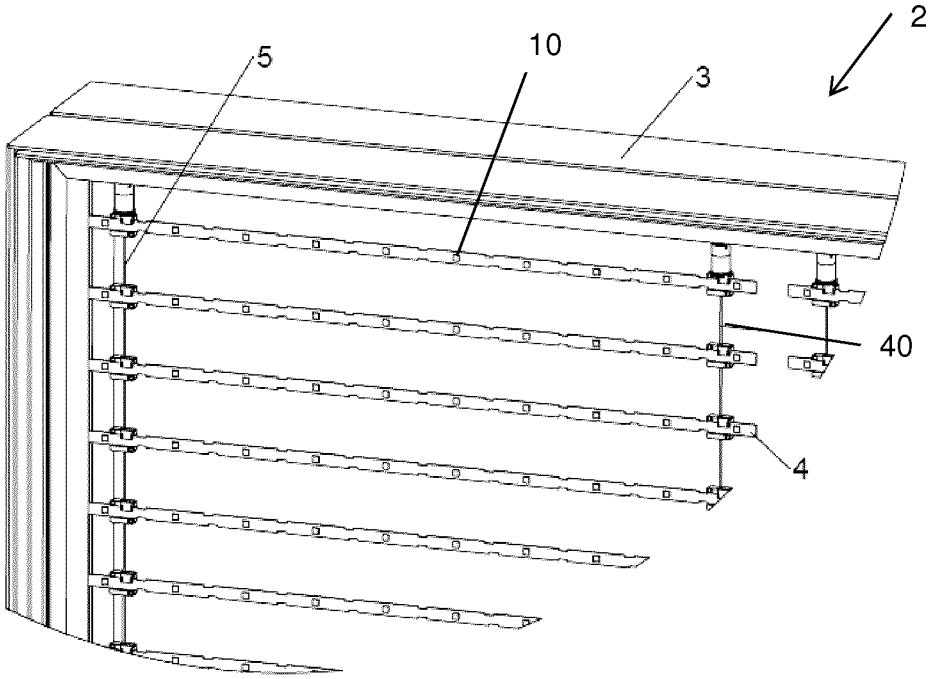
Figure 3:
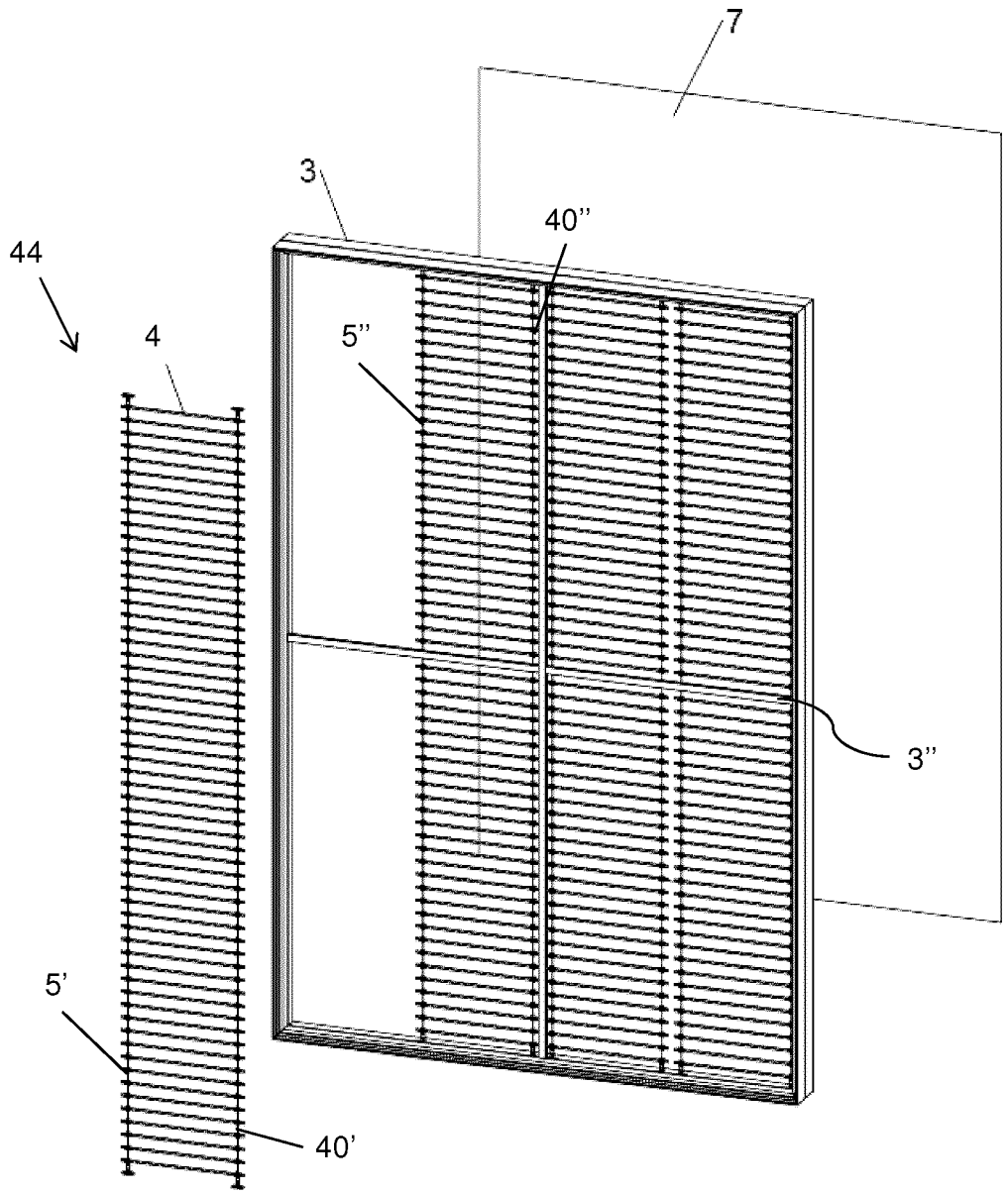
FIG. 3 is an exploded perspective view of an example lighting system.

Referring to FIGS. 2 and 3, the example lighting system 2 is provided. The lighting system 2 includes at least one first cable 5, at least one second cable 40 and a plurality of LED strips 4 comprising LEDs 10. In an example, the first cable and second cable extend between and are connected to opposite sides of the frame 3 along the entire height of the frame 3 (e.g. first cable 5' and second cable 40' of FIG. 3). In another example, the first cable and second cable can extend between opposite sides of the frame 3 along a portion of the height of the frame 3 (e.g. first cable 5" and second cable 40" of FIG. 3), in which case the frame 3 includes an intermediary portion 3" having sides for which one end of the first cable 5" and second cable 40" are connected. A plurality of LED strips 4 are electrically connected to the first cable 5 and second cable 40, near the ends of the LED strips 4 to form a LED assembly 44.

Figure 4:
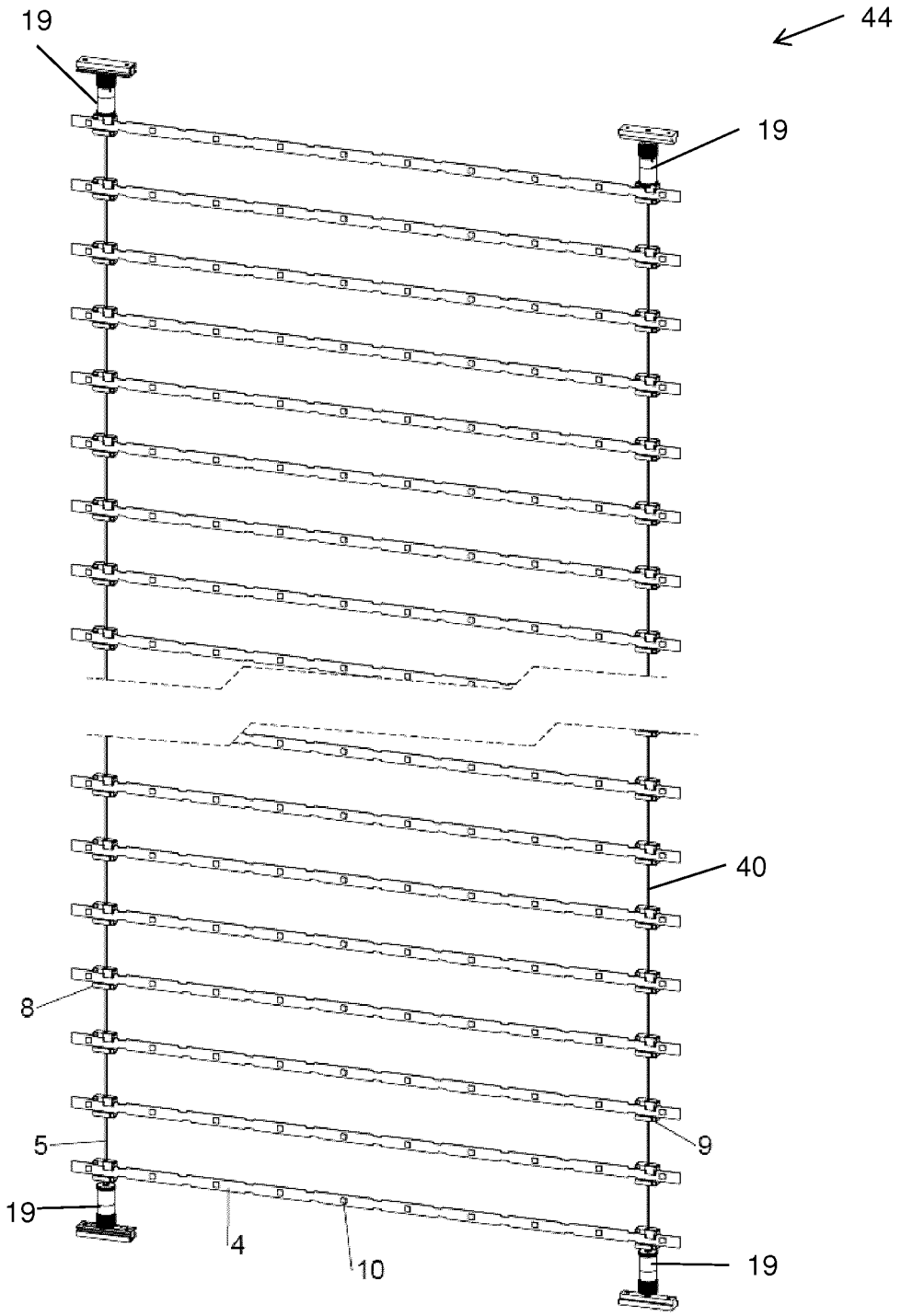
FIG. 4 is a perspective view of an example LED assembly.
Figure 5:
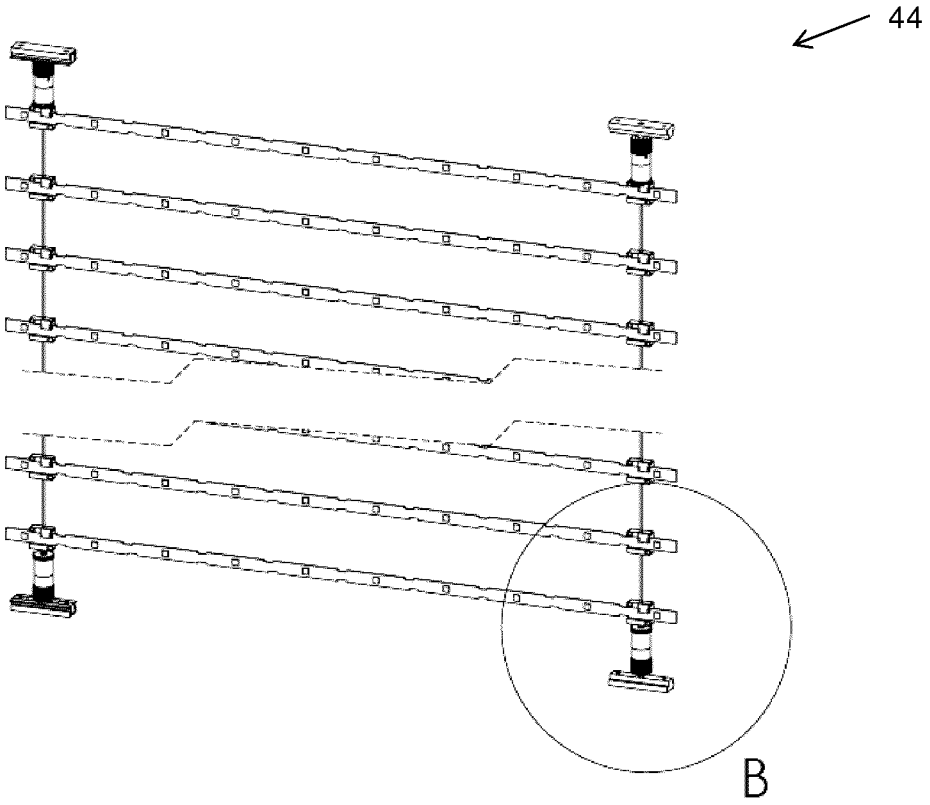
FIG. 5 is a perspective and expanded view of an example LED assembly.
Figure 5:
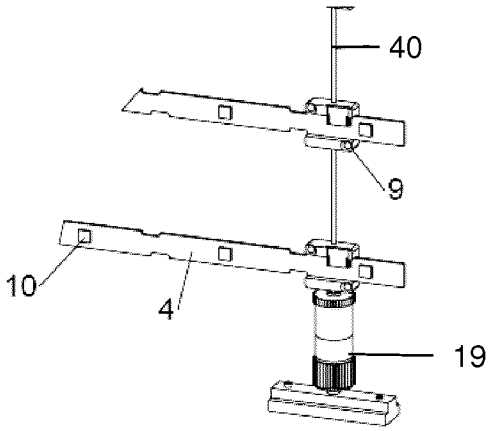

Referring to FIGS. 4 and 5, perspective views of an example LED assembly 44 of the first cable 5, second cable 40 and LED strips 4 are shown. The LED strips 4 are connected across the first cable 5 and second cable 40 to position rows of LEDs 10 in a matrix or grid arrangement. Each LED strip 4 can be connected to the first cable 5 using a first connector 8 and to the second cable 6 using a second connector 9. The LED assembly 44 can be mounted to the frame 3 by a cable tensioning system. An example cable tensioner system includes a cable tensioner 19 at each end of the first cable 5 and second cable 40. A first cable tensioner 19 couples an end of the first cable 5 to a side of the frame 3 and a second cable tensioner 19 couples the other end of the first cable 5 to the opposite side of the frame 3. A third cable tensioner 19 couples an end of the second first cable 40 to a side of the frame 3 and a fourth cable tensioner 19 couples the other end of the second cable 40 to the opposite side of the frame 3.

The LED strips 4 can be powered by a power supply with the positive terminal electrically coupled to a positive terminal of the LED strip 4 via the first cable 5 and first connector 8. The negative terminal of the power supply can be electrically coupled to a negative terminal of the LED strip 4 via the second cable 40 and the second connector 9. Current passes through the LED strip 4 to feed the LEDs 10 and cause the LEDs 4 to emit light. The first and second connectors 8 and 9 can be fixed on the first cable 5 and second cable 40, respectively, at substantially evenly spaced distances (subject to manufacturing tolerances and other practical constraints) so the distance between each LED strip 4 is the same to obtain homogeneity of the light diffused to the cover 7. In another example, the LED strips comprise a plurality of LEDs substantially evenly spaced (subject to manufacturing tolerances and other practical constraints) along the LED strip 4 and the LED strips 4 are substantially evenly spaced along the first cable 5 and second cable 40 at the same distance as the LEDs 10 are spaced apart on a LED strip 4, such that the LEDs 10 are uniformly distributed along both the direction of the cables and the LED strips 4. It will be appreciated that, in other examples, the LEDs 10 can be non-uniformly spaced along an LED strip 4, and the LED strips 4 can be non-uniformly placed along the first cable 5 and second cable 40.

Figure 6:
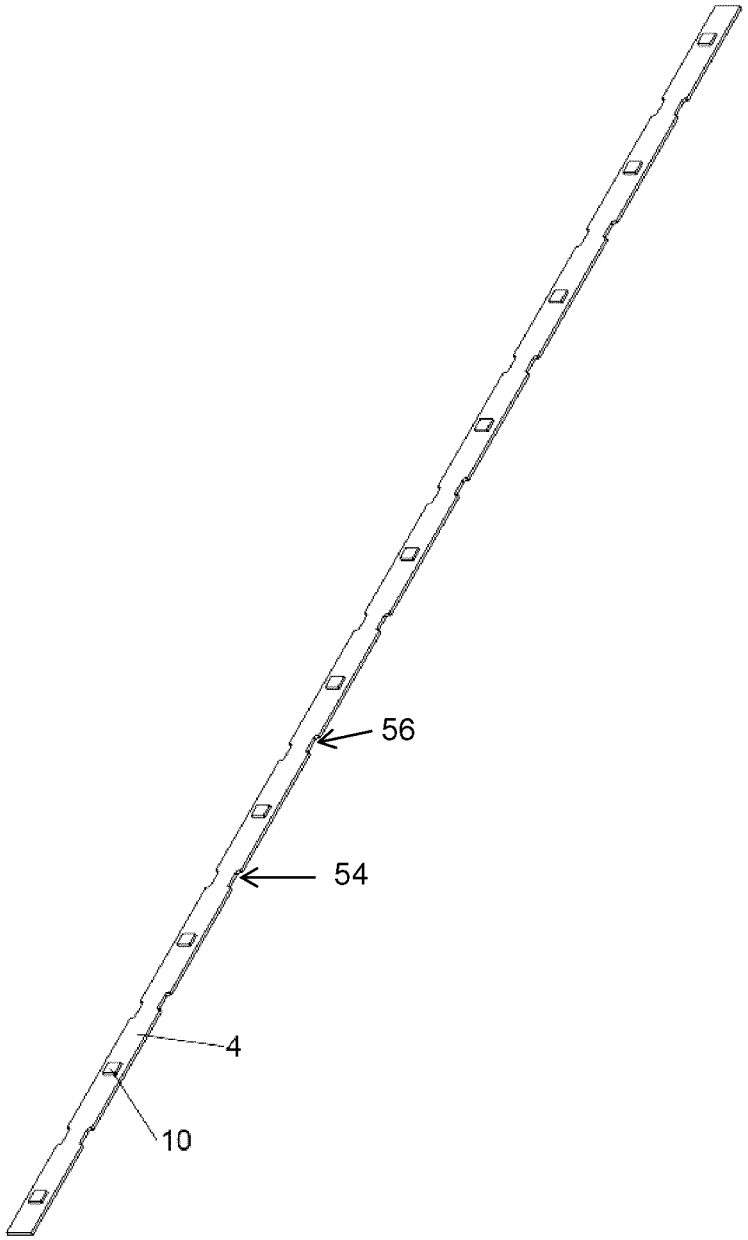
FIG. 6 is a perspective view of an example LED strip.

Referring to FIG. 6, an example LED strip 4 is shown. In one aspect, the LED strips 4 are printed circuit boards comprising one more positive terminal and negative terminal contacts, which when connected to a power source, cause the LEDs 10 to emit light. The example LED strip 4 of FIG. 6 includes a plurality of LEDs 10 across its length. In an example, the LED strip 4 can be cut in the gap between each LED 10, thus making a length of the LED strip 4 adjustable for frames of different sizes.

Figure 7:
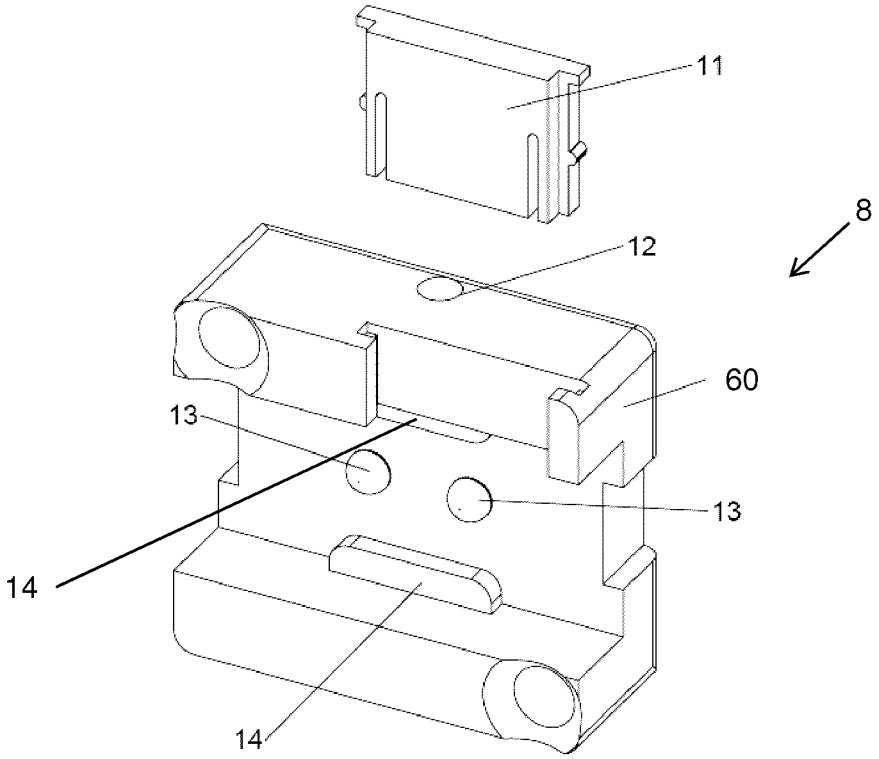
FIG. 7 is a front perspective view of an example first connector in an open position.
Figure 8:
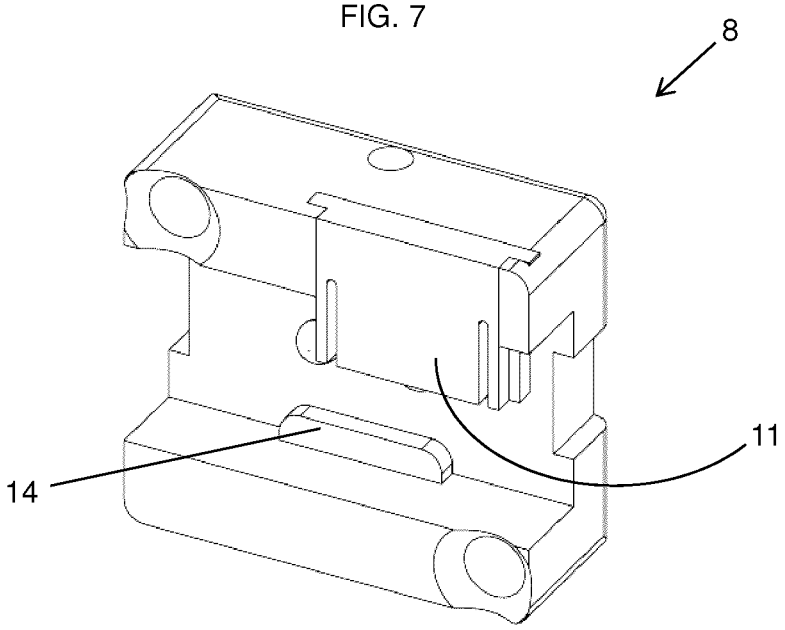
FIG. 8 is a front perspective view of an example first connector in a locked position.

Referring to FIGS. 7 to 10, an example first connector 8 is shown. The first connector 8 has includes a connector body 60 that can co-operates with a connector lock 11 to secure an LED strip 4 between interior surfaces of the connector body 60 and the connector lock 11. FIG. 7 shows a front perspective view of the first connector 8 in an opened position in which the connector lock 11 is not engaged with the connector body 60. FIG. 8 shows a front perspective view of the first connector 8 in a locked position in which the connector lock 11 is engaged with the connector body 60. The first connector 8 also includes a cable hole 12 for receiving the first cable 5, current points 13 for electrically connecting the first cable 5 placed within the cable hole 12 to the positive terminal of the LED strip 4. The first connector 8 also includes a cable case placed within the cable hole 12 which is electrically connected to the current points 13. In an example, the cable case takes on the form of a cylindrical tube, made of copper or other conductive metal, electrical connected to the current points. The cable case receives and holds the first cable 5 within the cable hole 12.

In an example, the components of the first connector 8 are made of a nonconductive material such as plastic, with the exception of the current points 13 and the cable case. The current points 13 can be made of a conductive metal, such as copper, to transmit the current received from the first cable 5 to the LED strips 4.

Figure 9:
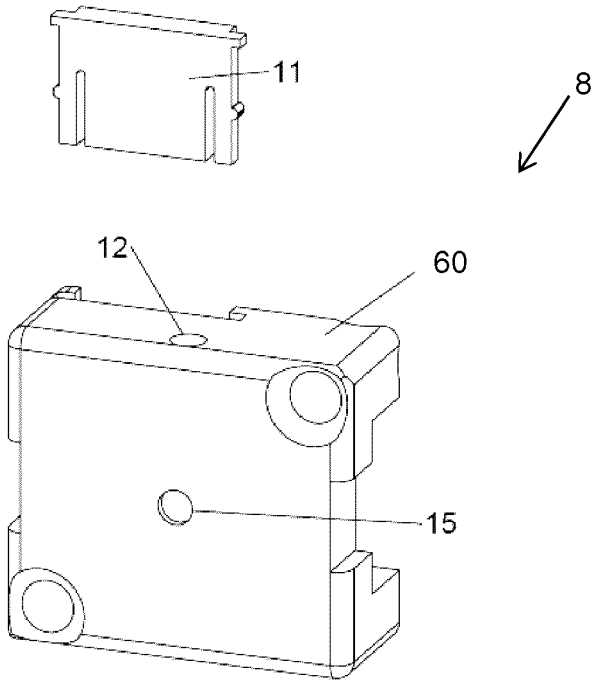
FIG. 9 is a back perspective view of an example first connector in an open position.
Figure 10:
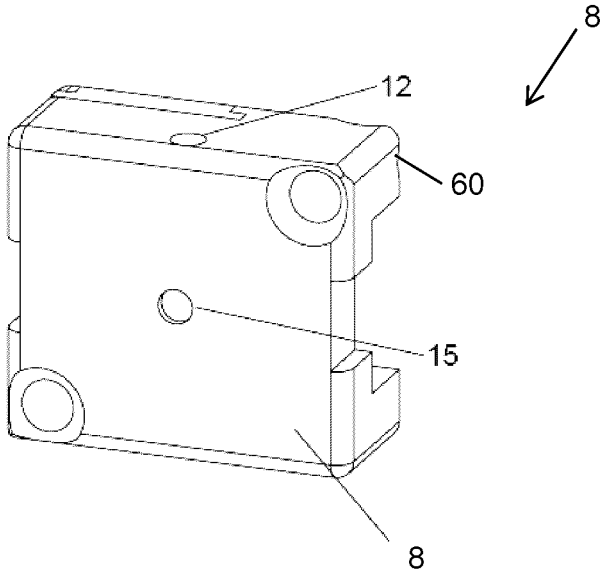
FIG. 10 is a back perspective view of an example first connector in a locked position.

Referring to FIGS. 9 and 10, rear perspective views of an example first connector 8 in an open position (FIG. 9) and in a locked position (FIG. 10) are shown. The connector body 60 includes a cable locker hole 15 to be used to connect the first cable 5 to the first connector 8.

Figure 11:
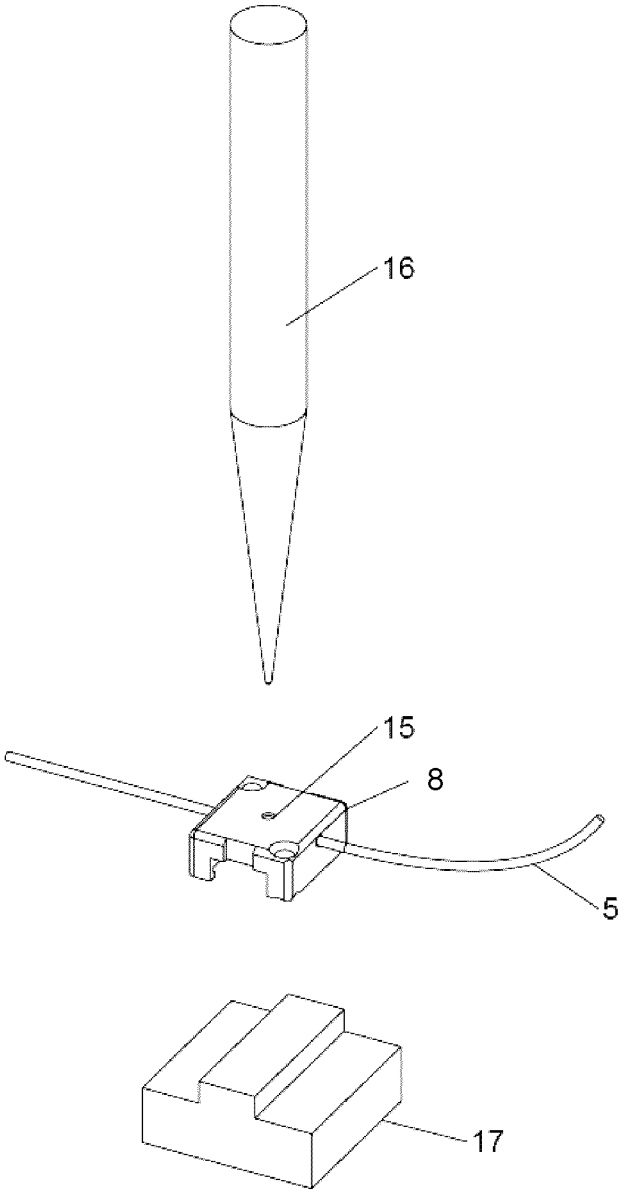
FIG. 11 is a perspective view of an example first connector with a first cable, a picker and a support.
Figure 12:
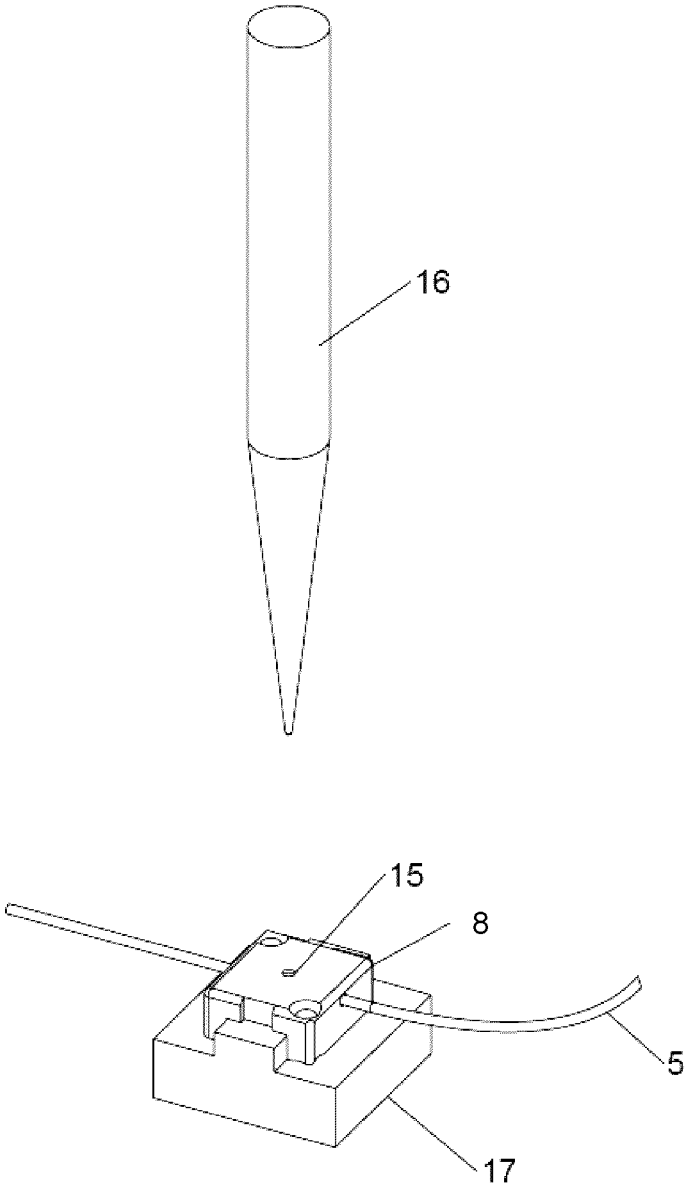
FIG. 12 is a perspective view of an example first connector with a first cable placed on the support, and a picker.
Figure 13:
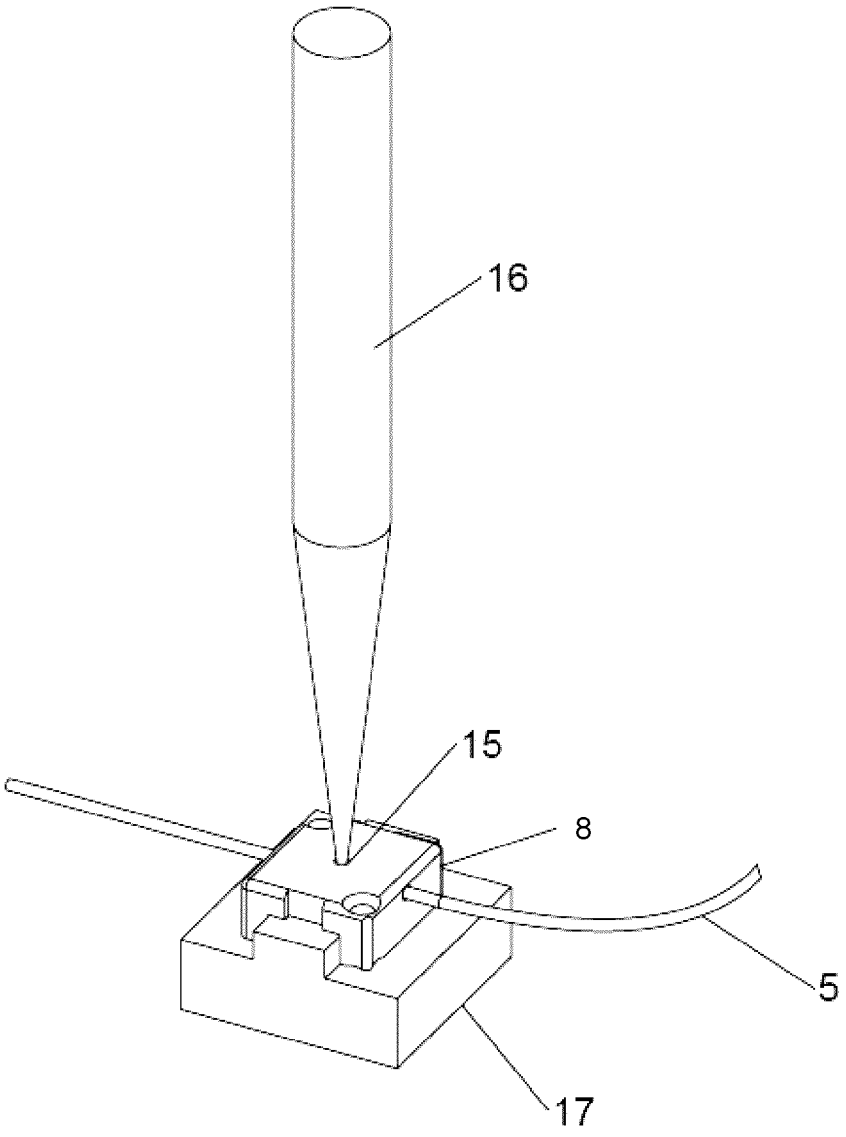
FIG. 13 is a perspective view of an example first connector with a first cable placed on the support, and a picker pressing the first connector and first cable.

FIGS. 11 to 13 illustrate an example method to connect the first cable 5 to the first connector 8. The first cable 5 is placed through the cable hole 12 and received by the cable case inside the cable hole 12 (FIG. 11). The first connector 8 is then placed on a support 17 (FIG. 12). The first cable 5 is then pressed at the location of the cable locker hole 15 with a picker 16 (or other suitable instrument) with a reasonable force to deform the cable case to hold the first cable 5 received by the cable case, and to form a crimp contact between the cable case and the first cable 5 (FIG. 13). The first cable 5 and the cable case are attached and electrically connected by the mechanical deformation of the cable case and first cable 5 caused by the picker 16.

Figure 14:
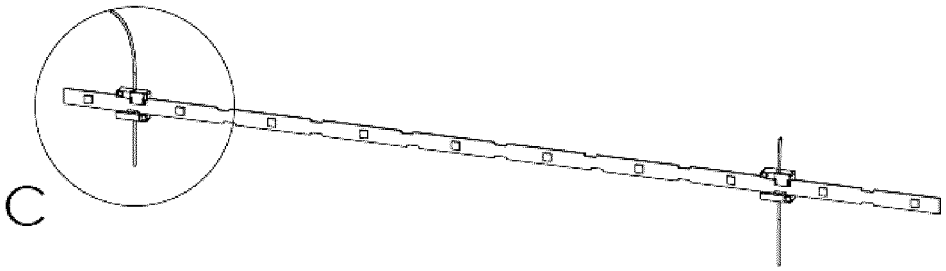
FIG. 14 is a perspective and expanded view of an example LED strip with the first cable and locked first connectors.
Figure 14:
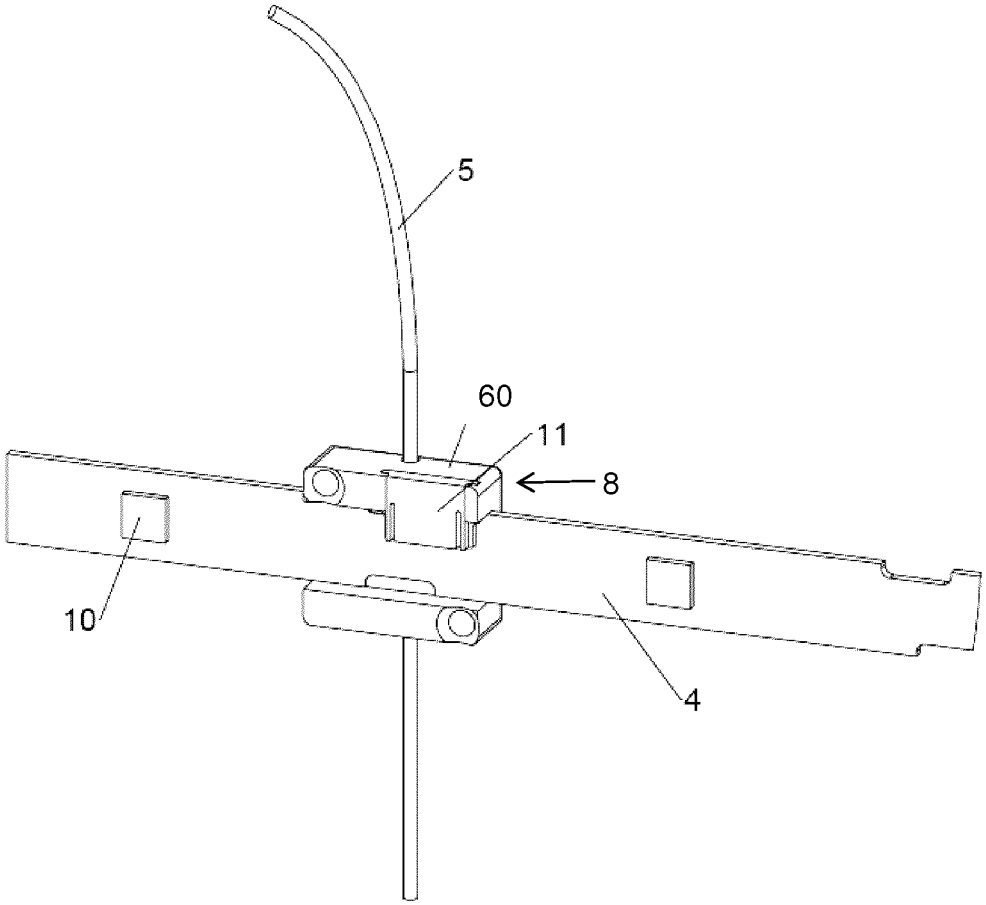
Figure 15:
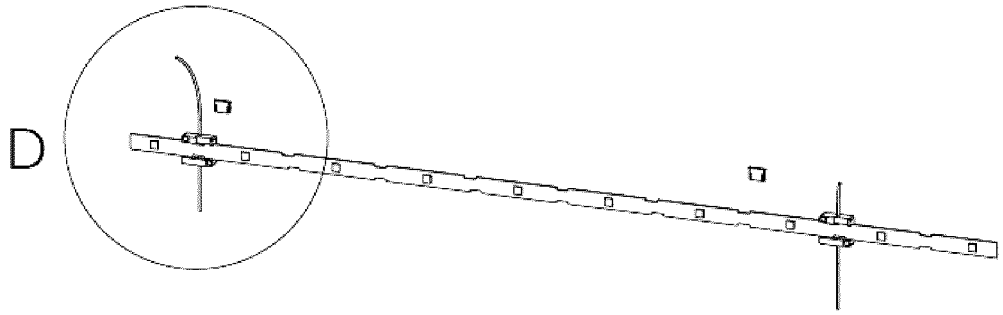
FIG. 15 is a perspective and expanded view of an example LED strip with the first cable and opened first connectors.
Figure 15:
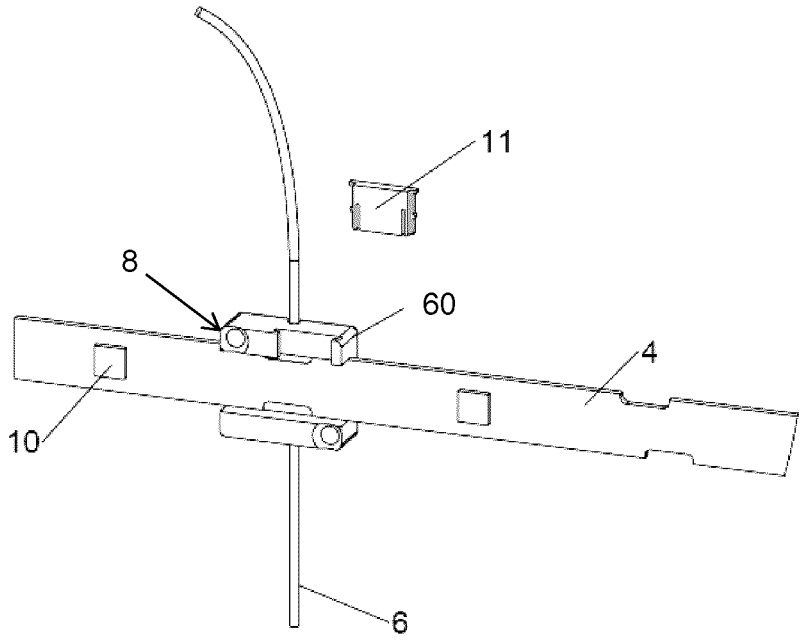
Figure 16:
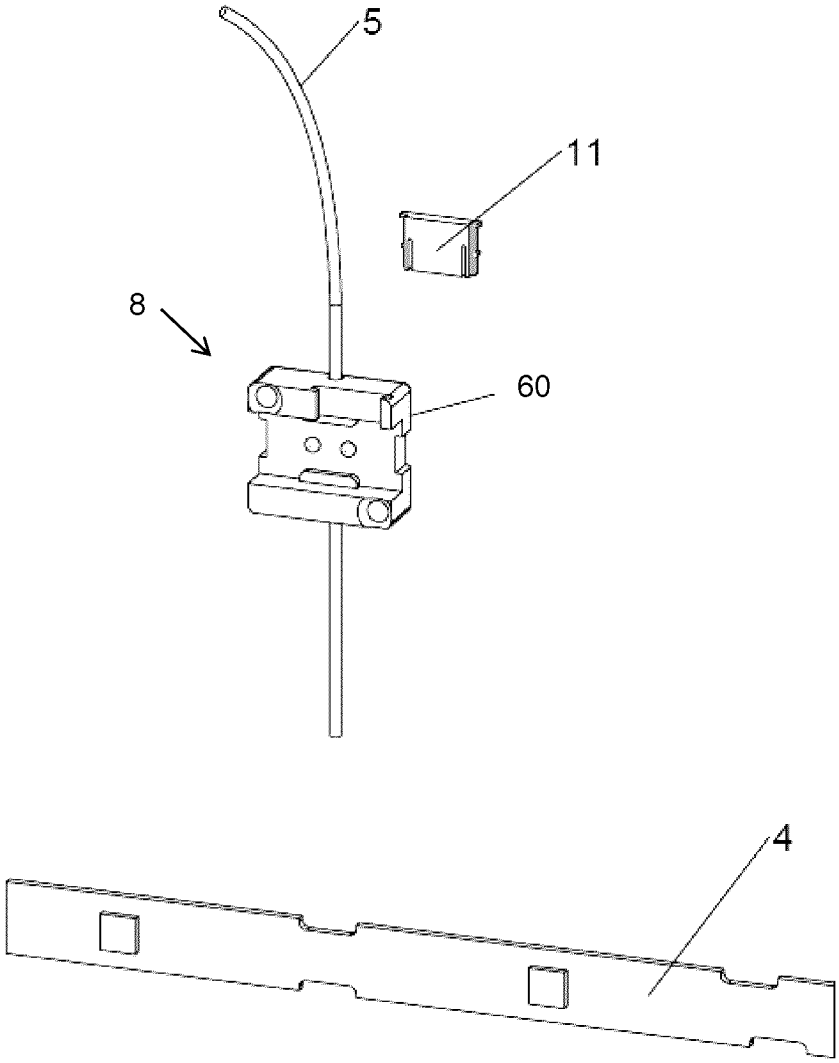
FIG. 16 is a perspective view of an example opened first connector with a first cable and a part of a LED strip.
Figure 17:
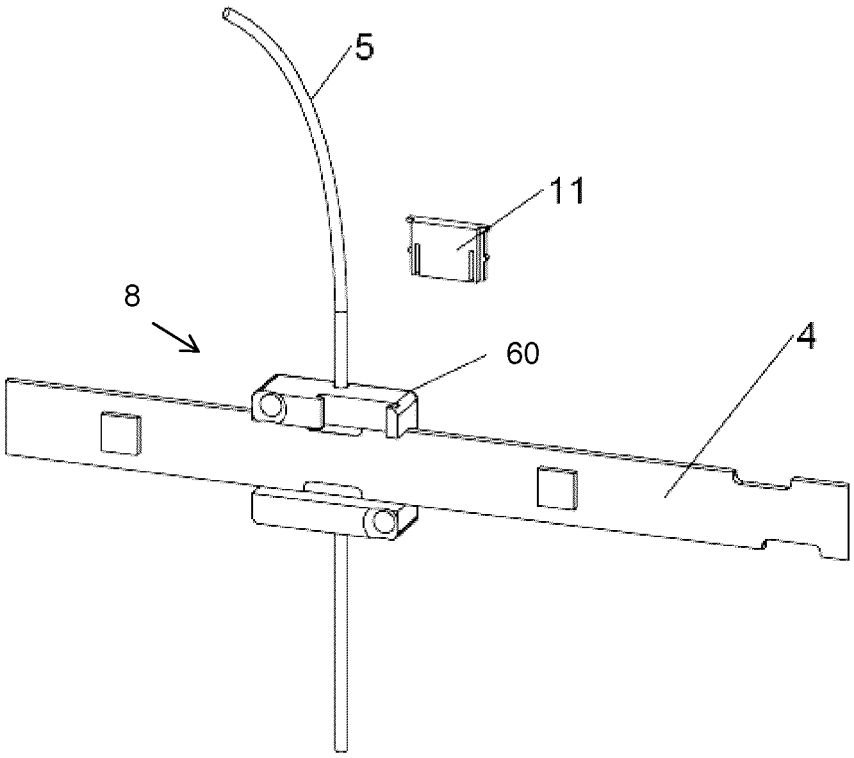
FIG. 17 is a perspective view of an example opened first connector with a first cable and part of a LED strip placed in the first connector.
Figure 18:
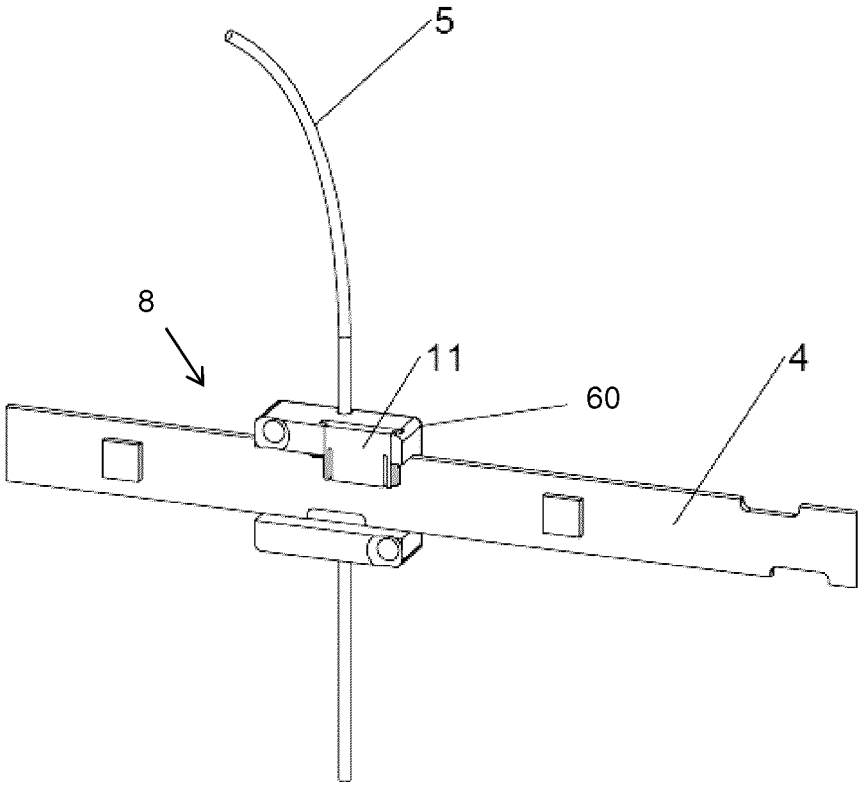
FIG. 18 is a perspective view of an example closed connector with a first cable and a part of a LED strip placed in the first connector.

After the first connector 8 is connected to the first cable 5, the LED string 4 can be secured to the first cable 5 using the first connector 8. FIG. 14 illustrates an example of an LED string 4 secured at one end by the first connector 8 in the locked position with the connector lock 11 secured to the connector body 60. FIG. 15 illustrates an example of an LED string 4 placed within the first connector 8 in the open position. An example of securing the LED strip 4 to the first cable 5 using the first connector 8 is illustrated in FIGS. 16 to 19. The LED strip 4 is placed in the first connector 8 (FIG. 17) within the connector body 60, and then secured to the first connector 8 by securing the connector lock 11 to the connector body 60.

Referring back to FIG. 6, in an example embodiment, the LED strips 4 can include a positive alignment indicator 54 to indicate the position of the positive terminal contact of the LED strip 4 and a negative alignment indicator 56 to indicate the position of the negative terminal contact of the LED strip 4. In an example, the positive alignment indicator 54 and negative alignment indicator 56 can be different (e.g. aligned indents of positive alignment indicator 54 and staggered indents of negative alignment indicator 56) so that the positive and negative terminals of the LED strip 4 can be easily identified. In another example, the first connector 8 can include positioners 14 (FIG. 7) to align and mate with the positive alignment indicator 54 of the LED strip 4 (FIG. 6). In the example of aligned indents of the positive alignment indicators 54 on the LED strip 4, the positioners 14 of the first connector 8 are aligned projections dimensioned to securely fit within the indents. Similarly, in the example of staggered indents of the negative alignment indicators 56, the second connector 9 can have staggered positioners positioned and dimensioned to mate with the staggered indents. Thus, distinct alignment indicators on the LED strip 4 and the distinct positioners of the first connectors 8 and the second connectors 9 ensure that the positive terminal of the LED strip 4 can only be connected to the first connectors 8 (which provide the positive terminal of the power supply), and the negative terminal of the LED strip 4 can only be connected to the second connectors 9 (which provide the negative terminal of the power supply).

It will be appreciated that the description of the first connector 8 is also applicable to the second connector 9. In an example, the first connector 8 and second connector 9 are the same. In another example, the first connector 8 and second connector 9 differ in the configuration of the positioners to connect to different parts of the LED strip 4.

Figure 19:
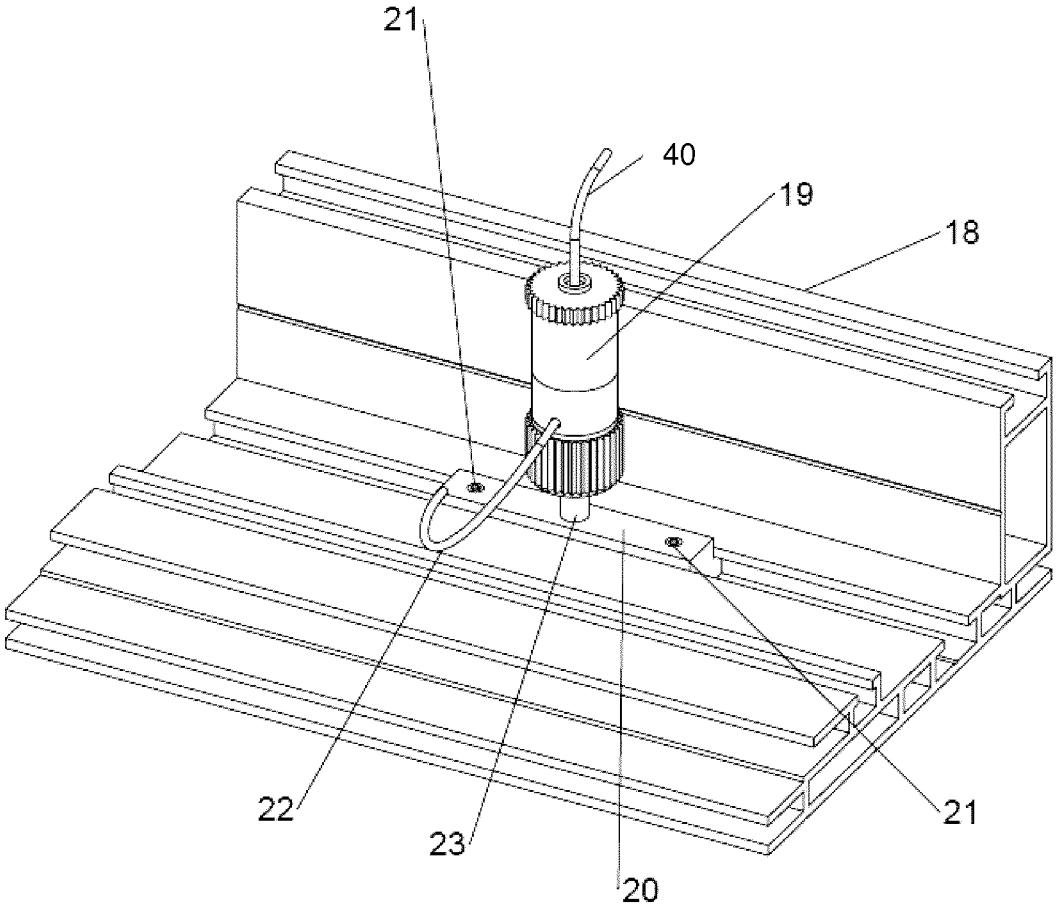
FIG. 19 is a partial perspective view of an example extruded aluminum profile of a frame with a second cable, an anchor and a cable tensioner.
Figure 20:
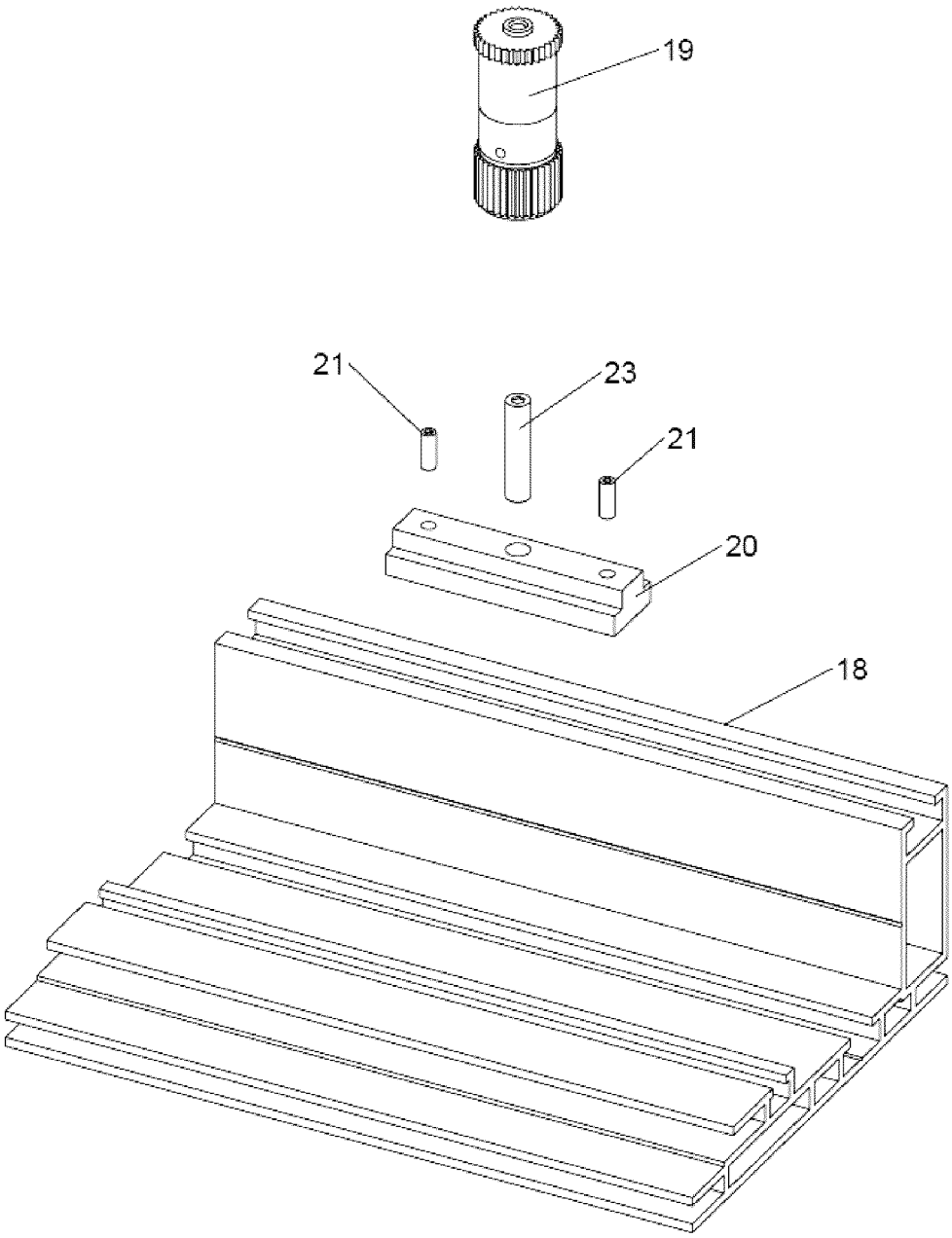
FIG. 20 is a partial exploded view of an example extruded aluminum profile of a frame, an anchor and a cable tensioner for a second cable.
Figure 21:
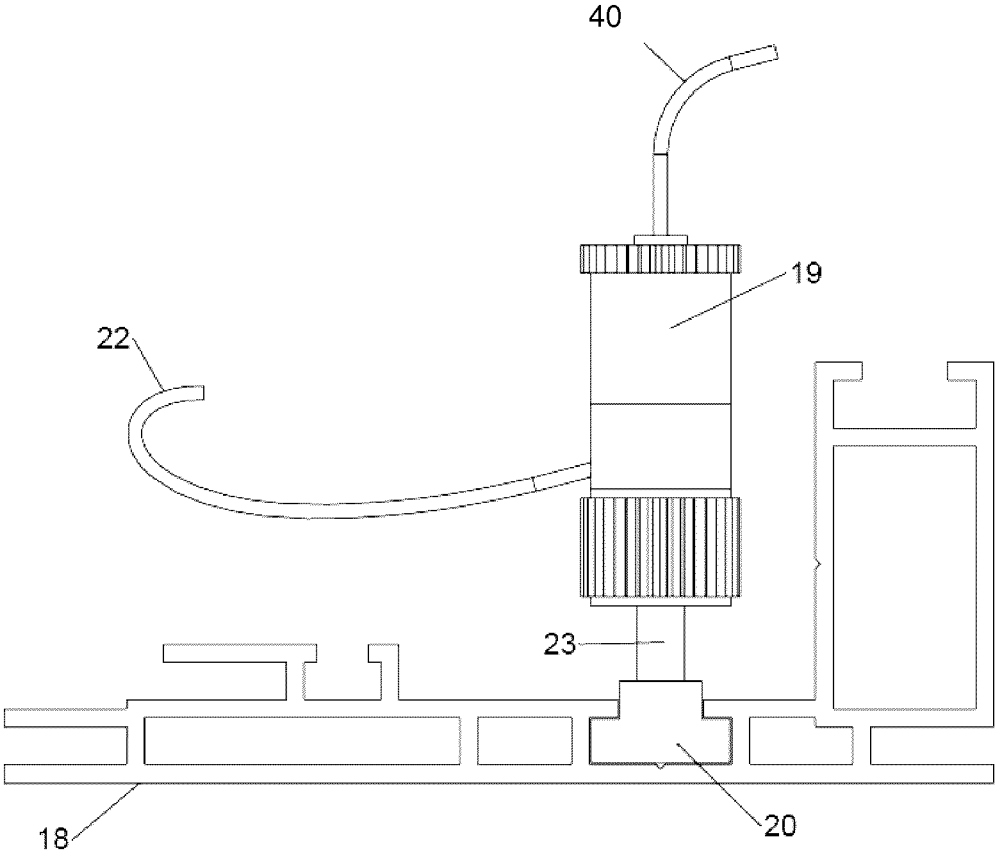
FIG. 21 is a side view of an example extruded aluminum profile of a frame with a second cable, an anchor and a cable tensioner.

As discussed above, the ends of the first cable 5 and second cable 40 can be secured to frame 3 using a plurality of cable tensioners 19. For example, FIG. 19 illustrates the second cable 40 secured to an extruded aluminum bar 18 of the frame 3 using a cable tensioner 19. The cable tensioner 19 is connected to an anchor 20 which is fixed to the frame 3. In an example, the anchor 20 is placed within groves of the aluminum bar 18 of the frame 3 and is slidable along the grooves for proper placement. The anchor 20 can be fixed to the frame 3 using fixing set screws 21 and the cable tensioner 19 can be attached to the anchor using a main set screw 23. It will be appreciated that other suitable fastening means can be used to fix the anchor 20 to the frame 3 and/or the cable tensioner 19 to the anchor 20. FIG. 20 shows the same elements of FIG. 19 in an exploded view without the second cable 40. FIG. 21 shows a side view of the anchor 20 inserted in the extruded aluminum bar 18 with the second cable 40 passing inside the cable tensioner 19, which is attached to the anchor 20 by the main set screw 23. The cable tensioner 19 couples an end of the second cable 40 to a side of the frame 3, and can be used to adjust the tension of the second cable 40.

Figure 22:
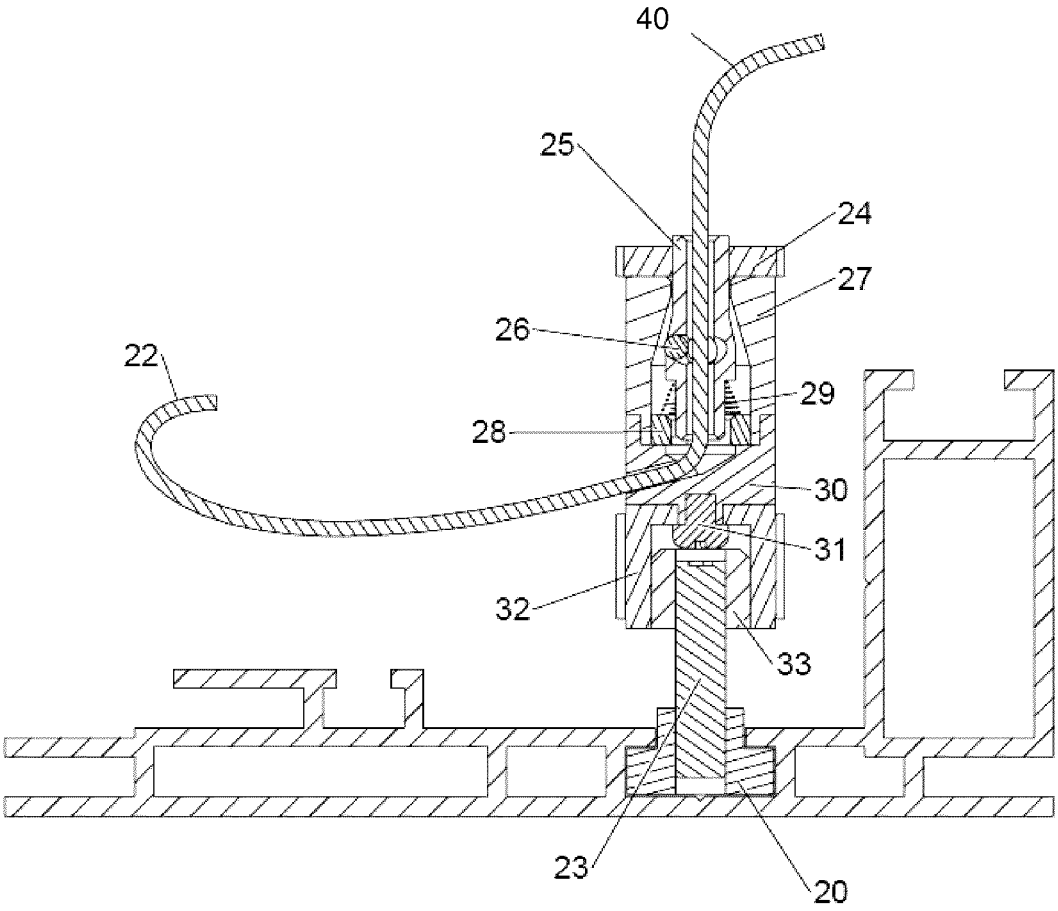
FIG. 22 is a cross-sectional view of FIG. 21.

In an example, the cable tensioner 19 receives an end 22 of the second cable 40 and adjusts the tension of the second cable 40 by adjusting the length of the second cable 40 extending across the frame 3, and also pulls on the second cable 40 once the length is fixed. A cross-section view of an example cable tensioner 19 is shown in FIG. 22. In this example, the cable tensioner 19 allows the second cable 40 to easily move toward the frame 3 but block the passage in the other direction unless a lock is released. The cable tensioner includes an upper case 27, medium body 30, swirling body 32 and a lock mechanism utilizing a spring 29 and spheres 26. The second cable 40 passes through a spheres case 25 within the upper case 27 surrounding the spheres 26, and existing the cable tensioner 19 by a side exits hole of the medium body 30. The medium body 30 is attached to the upper case 27 by a thread between the two bodies. The spheres case 25, together with the spheres 26 is pressed to the upper side of the upper case 27 by a spring 29, which is held in position by a spring lock 28. The swirling body 32 is rotatably attached to the medium body 30 by a screw 31. An interior nut 33 is attached to the swirling body 32 by a thread. The interior nut 33 also has an inside thread to receive the main set screw 23. The main set screw 23 is attached to the anchor 20 by a thread between their surfaces. A cable lock 24 can lock the cable in the desired position. Once the cable lock 24 is turned around the upper case 27, the thread between the spheres case 25 and the cable lock 24 forces the spheres case 25 to move upwards, which causes the spheres 26 to press against the second cable 40, locking the second cable 40 in place and preventing its movement. It will be appreciated that other types of cable tensioners can be used to adjust the tension of the second cable 40 and to couple the second cable 40 to the frame 3.

In an example, the second cable 40 is attached to the frame 3 and adjusted by first passing the second cable 40 through the cable tensioner 19 while separated from the frame 3. The anchor 20 is then placed inside the extruded aluminum bar 18 of the frame 3 and fixed in the frame 3 using the fixing set screws 21, followed with threading the main set screw into the anchor. The cable tensioner 19, with the second cable 40 inside, can then be attached to the anchor 20 by threading the main set screw 23 with the interior nut 33 of the cable tensioner 19.

Figure 23:
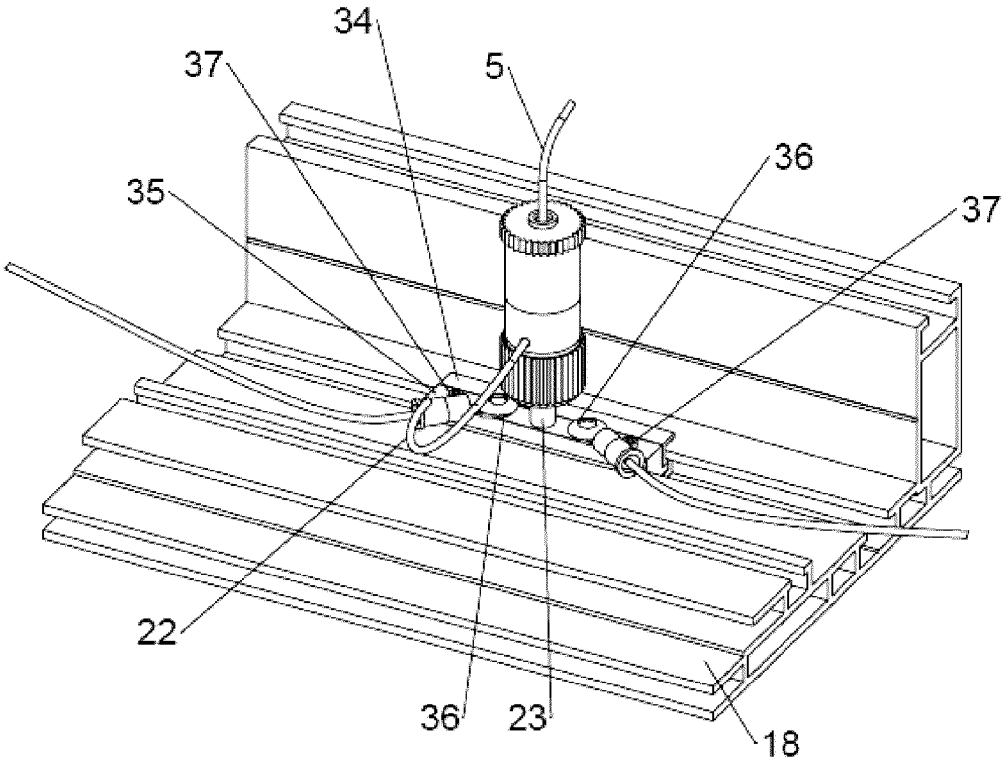
FIG. 23 is a partial perspective view of an example extruded aluminum profile of a frame with a first cable, an anchor and a cable tensioner.
Figure 24:
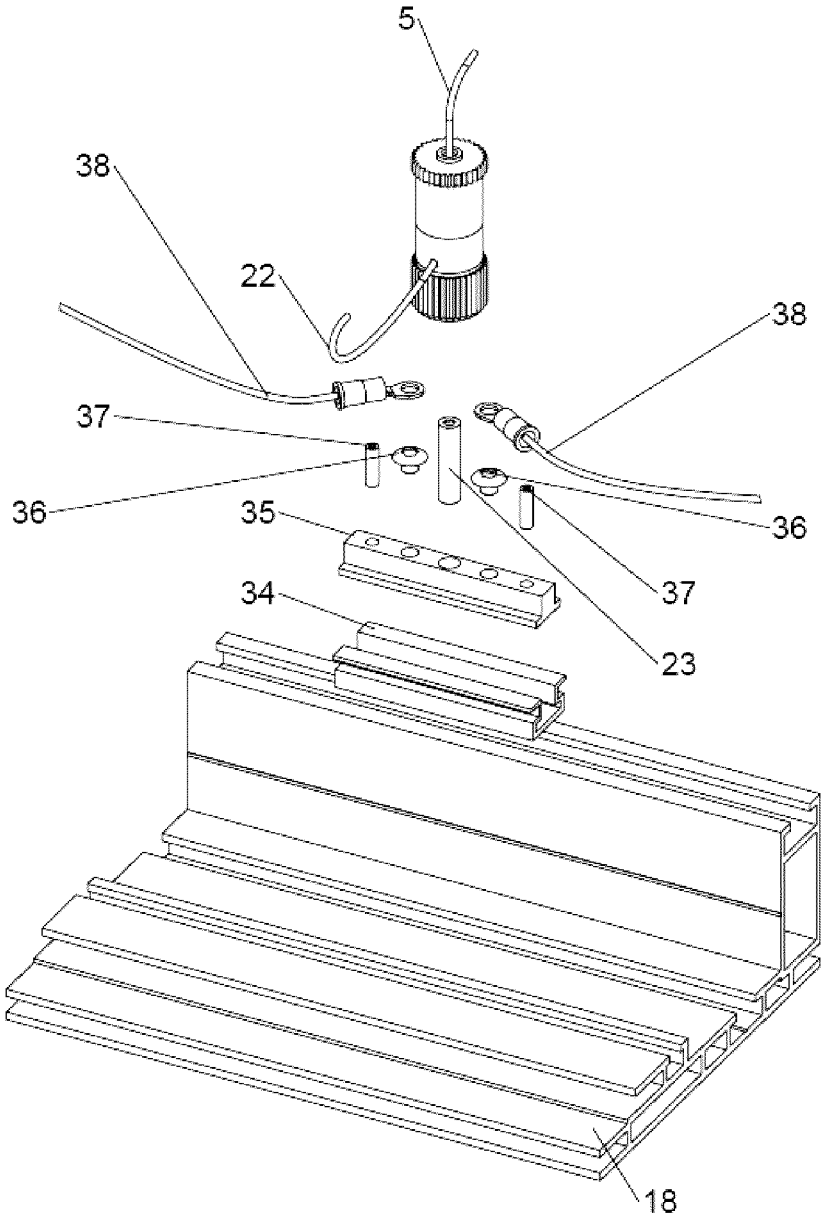
FIG. 24 is a partial exploded view of an example extruded aluminum profile of a frame, an anchor and a cable tensioner for a first cable.
Figure 25:
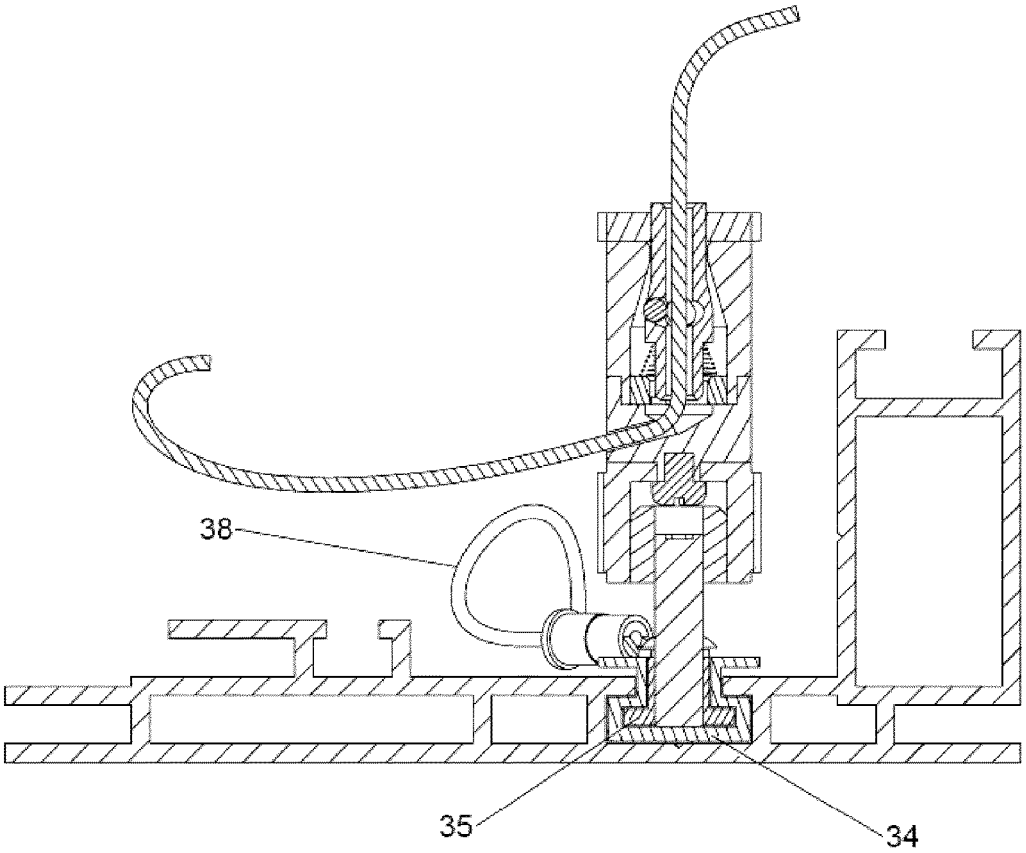
FIG. 25 is a cross-sectional view of an example extruded aluminum profile of a frame with a first cable, an anchor and a cable tensioner.
Figure 26:
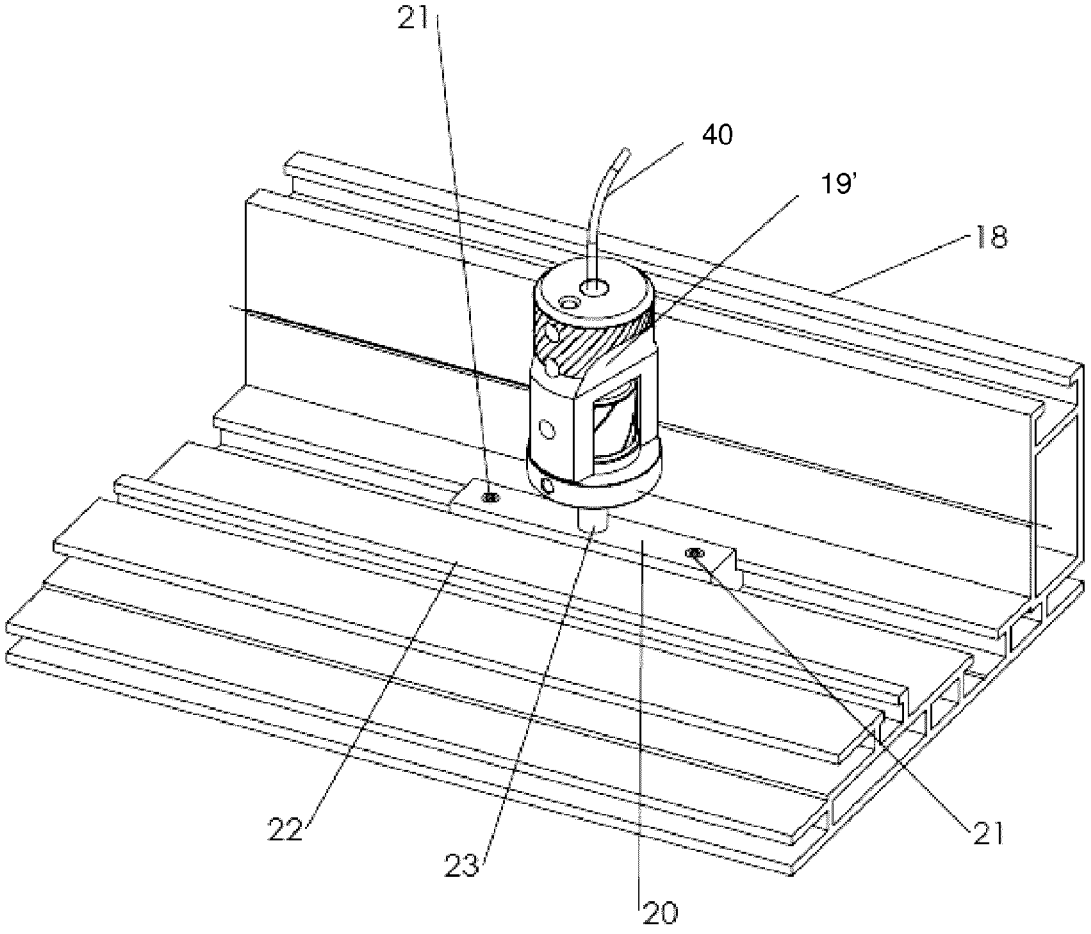
FIG. 26 is a partial perspective view of an example extruded aluminum profile of a frame with a second cable, an anchor and another example cable tensioner.
Figure 27:
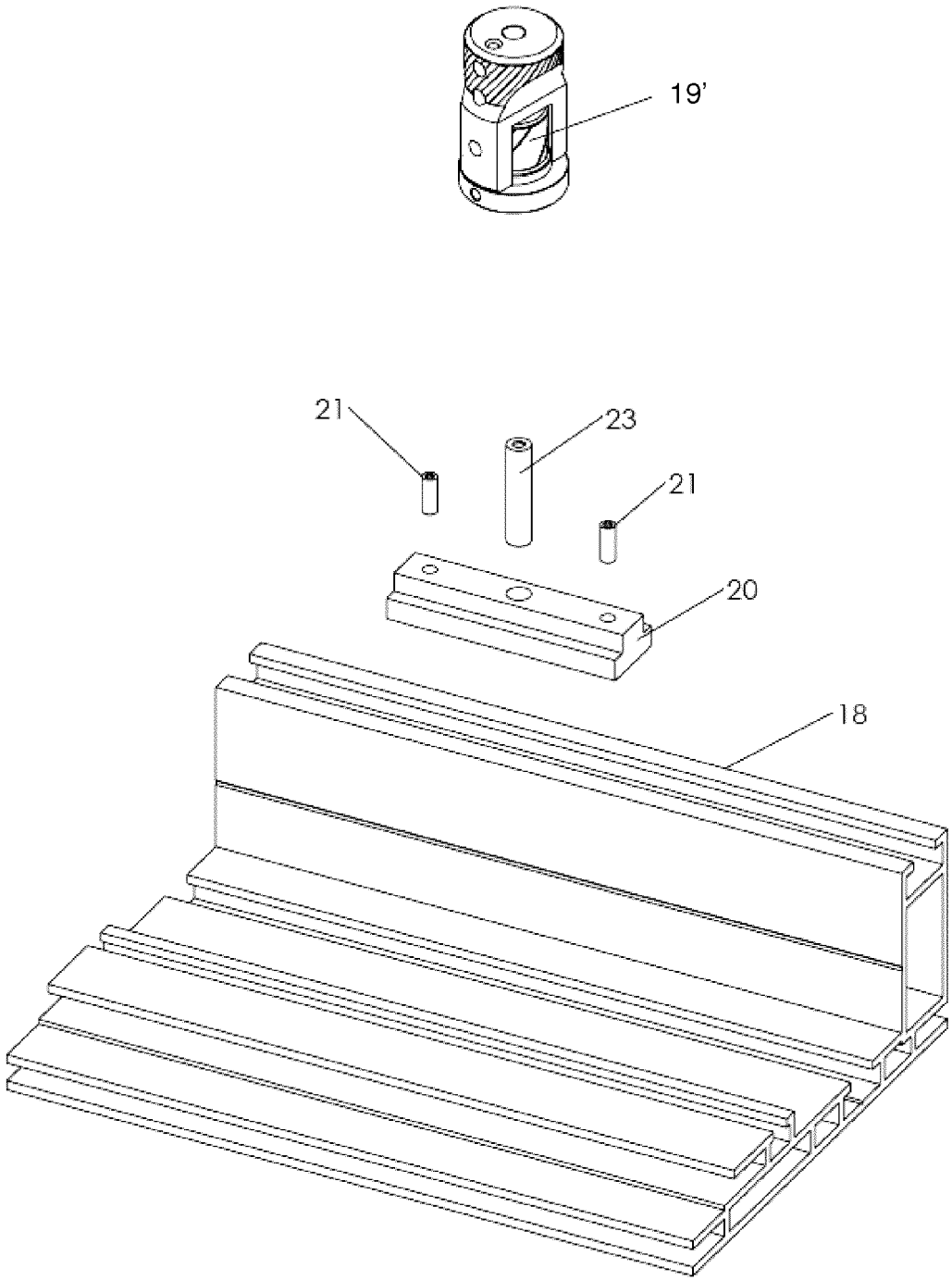
FIG. 27 is a partial exploded view of an example extruded aluminum profile of a frame, an anchor and another example cable tensioner for a second cable.
Figure 28:
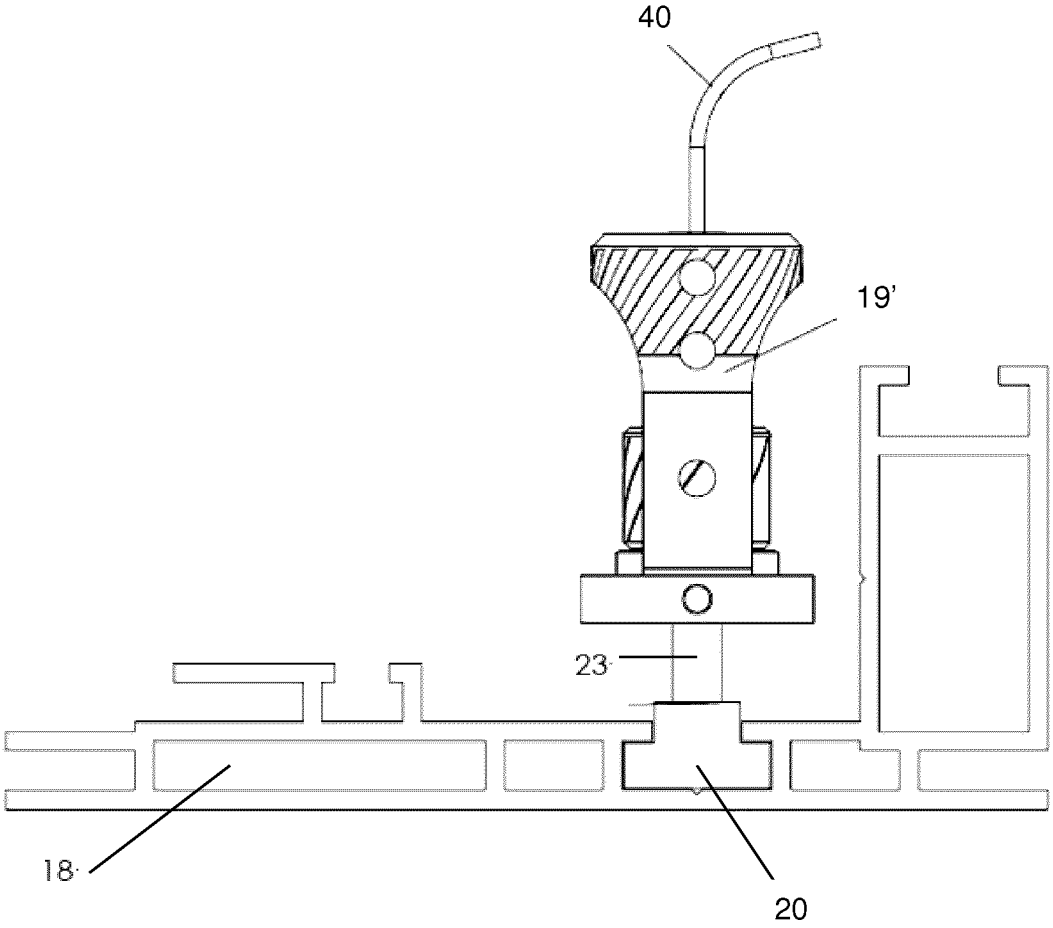
FIG. 28 is a side view of an example extruded aluminum profile of a frame with a second cable, an anchor and another example cable tensioner.

Referring to FIGS. 23 to 25, the first cable 5 can be attached to the frame 3 using a cable tensioner 19 in a similar manner as described with respect to the second cable 40, with the addition of an insulator 34 to insulate the first cable 5 from the frame 3. In an example, an insulator 34 placed between the anchor 35 and the extruded aluminum bar 18 of the frame 3 to insulate the anchor 35 from the extruded aluminum bar 18. Fixing set screws 37, used to fix the anchor 35 to the frame 3, can be made of polyester or other nonconductive material.

In an example, the first cable 5 is used to transmit current from a power source to power the LED strips 4. In this example, the anchor 35 receives current from the power source (or intermediate contact such as an anchor 35 of another first cable 5) by cables 38 connected at jumper screws 36 (FIGS. 23 and 24). The cables 38 can be connected to the positive terminal of the power supply. The negative terminal of the power supply can be connected to the anchor 20 of the second cable 40 or directly to the frame 3.

Referring back to FIGS. 2 to 3, once the LED assemblies 44 are assembled and attached to the frame 3, the height of the first cables 5 and second cables 40 can be adjusted using the cable tensioners 19. For example, the end of the first cables 5 and second cables 40 can be pulled in the direction of the bar 18 or pressing down the spheres case 25 to liberate the cable in the opposite direction. Once the distance of the cables are roughly adjusted, the cable lock 24 can be tightened for finer adjustment and the tension can be adjusted by turning the swirling body 32 around the main set screw 23. Tension to the first cables 5 and second cables 40 cables can be applied using the cable tensioners 19 to straighten the cables and/or maintain the cables straight.

In another embodiment, the first cable 5 and second cable 40 can comprise a copper core and a plurality of wires having a higher tensile strength, such as steel. For example, the first cable 5 and second cable 40 can be comprise a 7×19 cable, having a copper core strand of 19 wires, surrounded by 6 strands made of a steel (e.g. stainless steel), or a combination of steel and copper (or copper alloy) strands. Increasing the tensile strength of the first cable 5 and second cable 40 enables the cables to withstand greater tension such that the first cable 5 and second cable 40 can be pulled with a greater force, and thus providing a flatter and more planar arrangement of LEDs 10 extending across the first cable 5 and second cable 40. A flatter arrangement can provide more uniform lightning as the LEDs 10 are uniformly spaced from the cover 7 within the frame 3, and can also allow for the frame to be made with a thinner profile as the extent of unevenness in the plane of LEDs is reduced or eliminated.

In another embodiment, the LED strips 4 can include LEDs 10 on both surfaces of the LED strips 4, such that a cover 7 can be mounted on opposite external faces of the lighting system 2.

In an example embodiment, the lighting system 2 may be assembled on-site. In another example, the LED strips 4 can be detachably connected to the first connectors 8 and second connectors 9, and/or the cable tensioners 19 (and thus the light assembly 44) may be detachably connected to the frame 3. The frame may also comprise of parts that can be assembled/disassembled.

It will be appreciated that the frame 3 can include any suitable bracket or extruded profile that can secure the cable tensioners 19 on the frame 3. It will also be appreciated that the shape of the frame 3 can be a square, rectangle or any other shape in which the first cable 5 and second cable 40 can be affixed to two sides of the frame.

Figure 29:
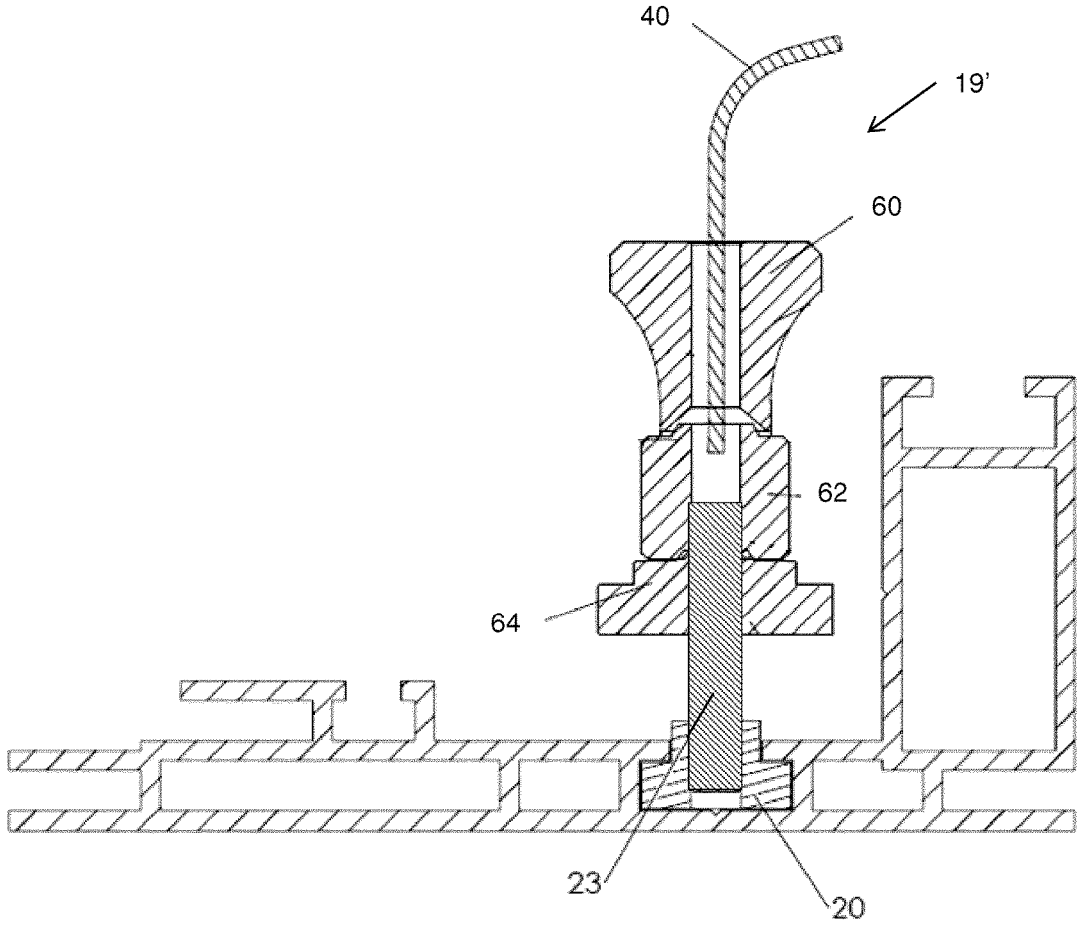
FIG. 29 is a cross-sectional view of FIG. 28.

Referring to FIGS. 26 to 29, another example of the cable tensioner 19' that can be used with the second cable 40 is shown. As shown in FIG. 29, the cable tensioner 19' includes an upper portion 60, adjustment portion 62 and lower portion 64. The upper portion receives the second cable 40 and secures the second cable using screws (not shown) or any other suitable fastening means. The lower portion 64 includes a bore to receive the main set screw 23 such that the adjustment portion 62 is engaged with the main set screw 23 by threads within the inner surface of the adjustment portion 62. The lower portion 64 and upper portion 60 are attached together and enclose the top and bottom of the adjustment portion 62. The adjustment portion 62 can be turned about the threaded main set screw 23 such that the adjustment portion 62 moves towards or away from the the frame 18, thus causing the upper portion 60 to move with the adjustment portion 62 and adjust the tension on the second cable 40 as it its pulled towards or away from the anchor 20. The components of the cable tensioner 19' can be made of a conductive material to form an electrical connection between the second cable 40 and the main set screw 23 of the anchor 20.

Figure 30:
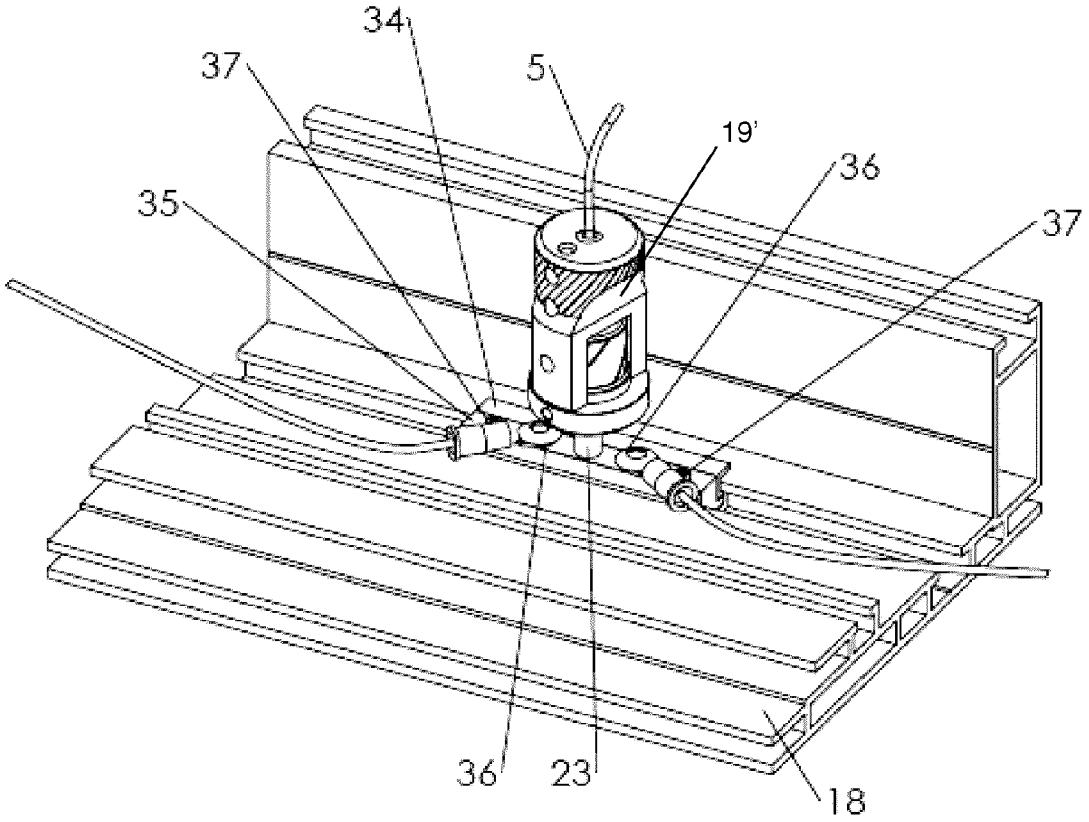
FIG. 30 is a partial perspective view of an example extruded aluminum profile of a frame with a first cable, an anchor and another example cable tensioner.
Figure 31:
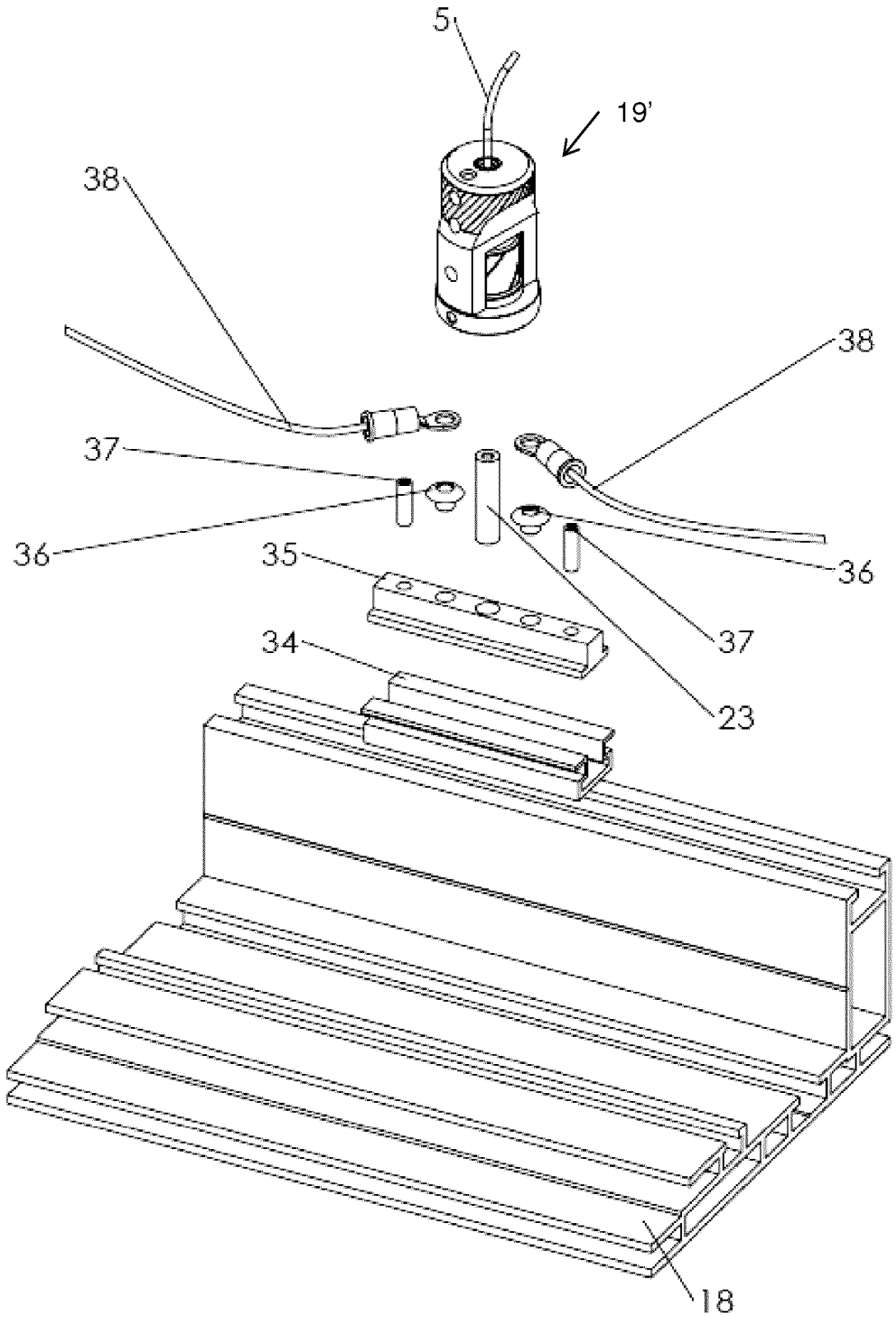
FIG. 31 is a partial exploded view of an example extruded aluminum profile of a frame, an anchor and another example cable tensioner for a first cable.
Figure 32:
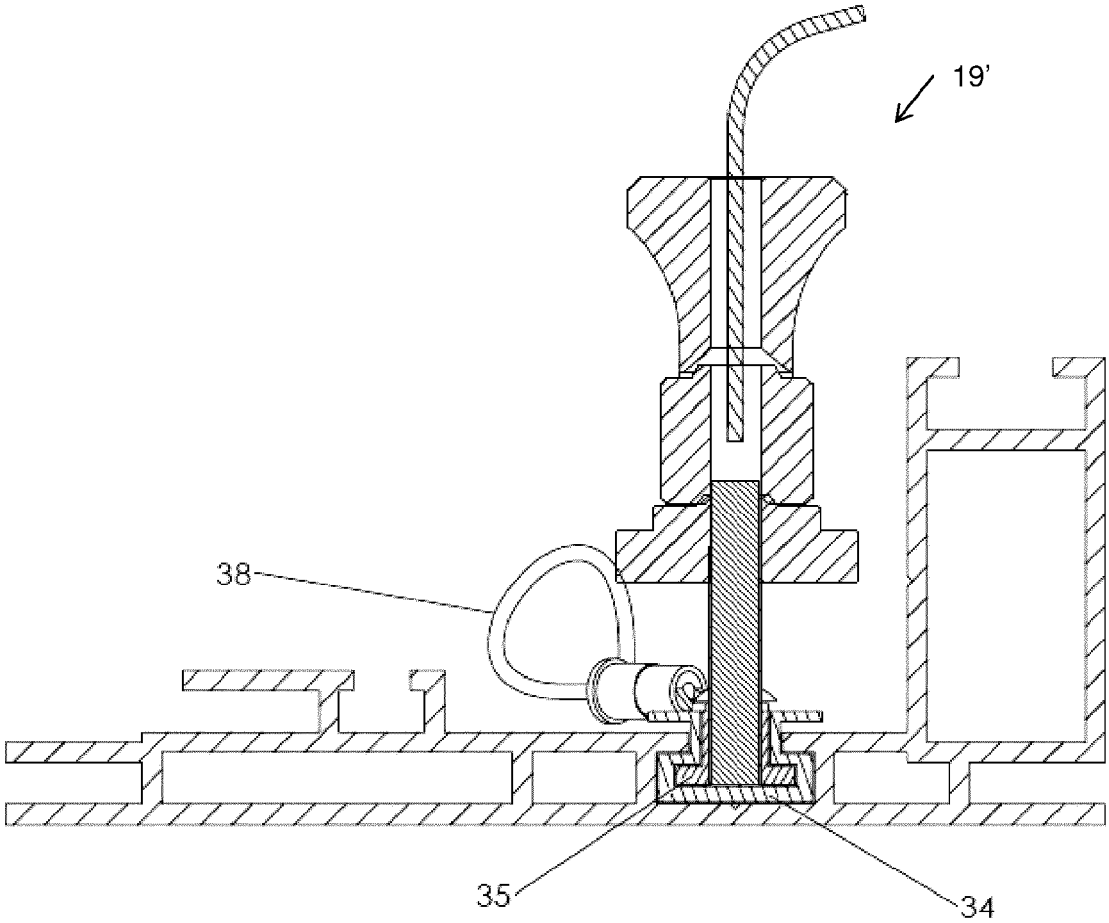
FIG. 32 is a cross-sectional view of an example extruded aluminum profile of a frame with a first cable, an anchor and another example cable tensioner.

Referring to FIGS. 30 to 32, the first cable 5 can be attached to the frame 3 using a cable tensioner 19' in a similar manner as described with respect to the second cable 40, with the addition of an insulator 34 to insulate the first cable 5 from the frame 3.

Although the examples above have described the lighting system 2 mounted within a frame 3, it will be appreciated that the lighting system 2 can be used in other installation locations and environments. For example, anchors 20 can be fixed to a ceiling and floor such that the first cable 5 and second cable 40 extend from a floor to a ceiling. In another example, the anchors 20 can be attached to brackets located at desired installation locations, instead of a frame 3.

Figure 33:
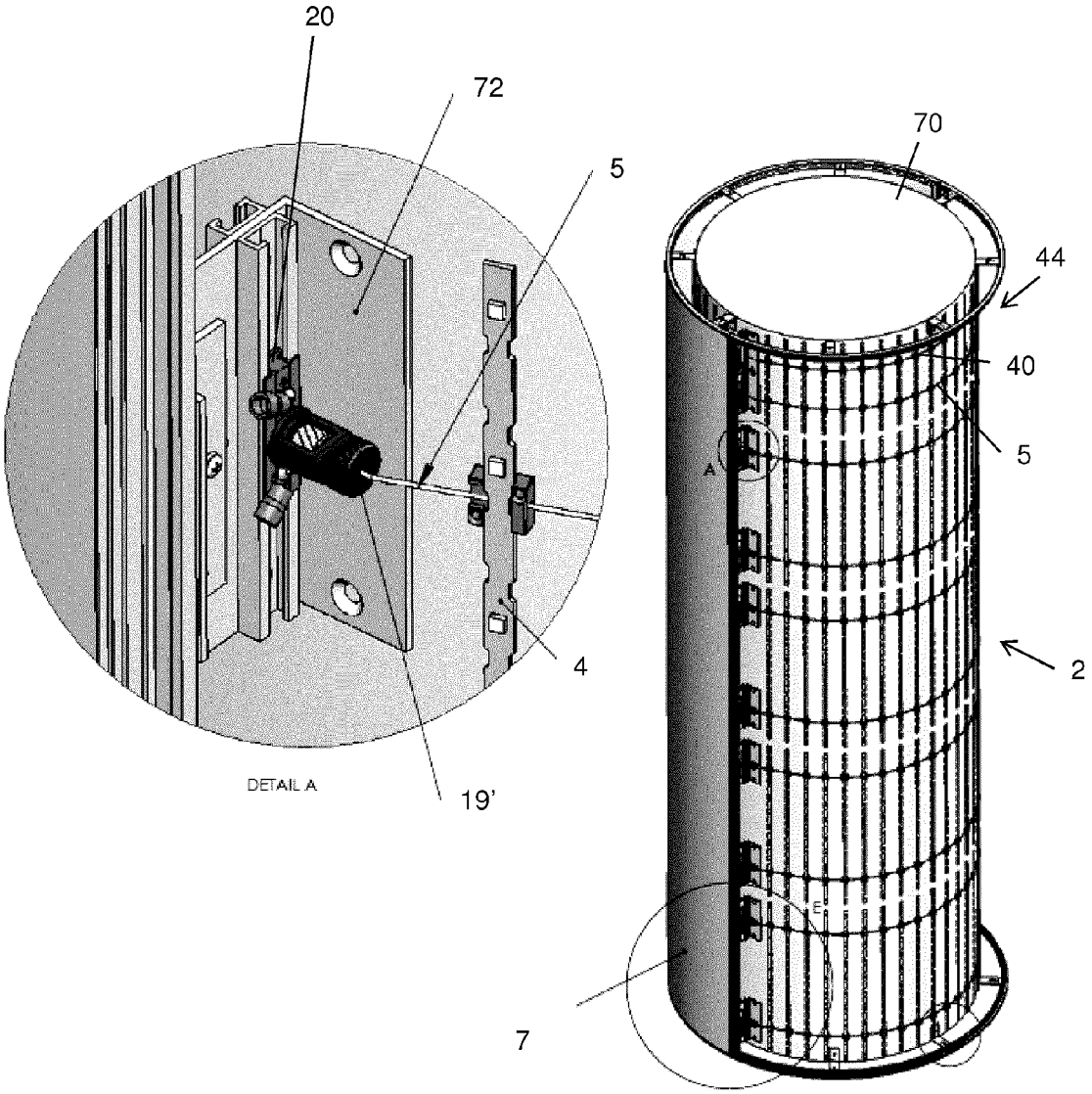
FIG. 33 is a cutaway and expanded view of an example lighting system used on a column.

In another example, FIG. 33 illustrates the lighting system 2 used on a column 70 to illuminate a cylindrical cover 7 surrounding the column. In this example, each LED assemblies 44 of the lighting system 2 spans a portion of the height of the column 70. The first cables 5 and second cables 40 extend circumferentially around the column 70. In this example, the LED strips 4 extend in the vertical direction. The end of the first cable 5 can be connected to a cable tensioner 19' that is connected to an anchor 20. The anchor 20 can be secured to a bracket 72 which is also fixed to the column 70. From this example, it can be seen that the lighting system 2 can be used on a variety of different installation locations. In some examples, brackets or other mounting assemblies can be used to attach the anchor 20 or other component of the light system 2 to an installation location. It will be appreciated that the first cables 5 and second cables 40 can be oriented vertically, horizontally or other directions, and can be configured to follow flat, curved or other contoured surfaces to form LED assemblies.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A lighting system comprising:

a frame having an inner surface comprising at least two opposite portions;

a first cable and a second cable for receiving a voltage difference, the first cable extending within the frame between a first pair of installation locations on the at least two opposite portions of the inner surface the frame and the second cable extending within the frame between a second pair of installation locations on the at least two opposite portions of the inner surface the frame, the first cable is electrically coupled to a positive terminal of a power supply providing the voltage difference and the second cable, distinct from the first cable, is electrically coupled to a negative terminal of the power supply, the first pair of installation locations and the second pair of installation locations being distinct from one another;

a plurality of light emitting diode (LED) strips, each LED strip electrically connected to and extending between the first cable and the second cable; and a cable tensioner system coupled to the first cable and the second cable for controllably pulling on the first cable extending between the first pair of installation locations thereby adjusting the tension of the first cable and for controllably pulling on the second cable extending between the second pair of installation locations thereby adjusting the tension of the second cable.

2. The lighting system of claim 1, wherein each LED strip is connected to the first cable using a first connector and connected to the second cable using a second connector distinct from the first connector, the LED strip comprising a first indicator for aligning with the first connector and a second indicator for aligning with the second connector.

3. The lightning system of claim 2, wherein the first indicator is structurally different from the second indicator.

4. The lighting system of claim 3, wherein the first indicator comprises a pair of aligned indents on lateral sides along the LED strip and the second indicator comprises a pair of staggered indents on lateral sides along the LED strip.

5. The lighting system of claim 2, wherein the LED strips comprise a plurality of contacts connectable to the first connector and second connector.

6. The lighting system of claim 1, wherein the plurality of LED strips is detachably connected to the first cable and second cable.

7. The lighting system of claim 1, wherein at least one of the first cable and second cable comprises a copper core and a plurality of wires having a higher tensile strength than the core.

8. The lighting system of claim 7, wherein the wire having a higher tensile strength comprises steel.

9. The lighting system of claim 1, wherein the cable tensioner system comprises a first cable tensioner at one end of the first cable and a second cable tensioner at one end of the second cable, such that tension of the first cable and second cable can be independently adjusted.

10. The lighting system of claim 9, wherein the cable tensioner system further comprises a third cable tensioner at the other end of the first cable and a fourth cable tensioner at the other end of the second cable, such that the tension of the first cable and second cable can be adjusted at both respective ends.

11. The lighting system of claim 9, wherein at least one of the cable tensioners is fixed onto the frame to one of the installation locations using an anchor.

12. The lighting system of claim 11, wherein the anchor is conductive and wherein the first cable tensioner is attached to the anchor and the anchor is electrically coupled to the positive terminal of the power supply through one or more other anchors electrically connected in series.

13. The lighting system of claim 11, wherein the frame is formed from an extruded bracket and the anchor is slidable along the extruded bracket at the installation location.

14. The lighting system of claim 1, wherein the first cable is electrically insulated from the frame and the second cable is electrically coupled to the frame.

15. The lighting system of claim 1, wherein the cable tensioner system is detachably coupled to the installation locations.

16. The lighting system of claim 1, wherein the first pair of installation locations and second pair of installation locations are parts of the frame.

17. The lighting system of claim 1, wherein each of the LED strips comprises opposite sides and comprises a plurality of LEDs on at least one of the opposite sides of the LED strip and wherein each of the plurality of LEDs face a cover positioned over the frame to be illuminated by the LED strips.

18. The lighting system of claim 17, wherein at least one of the covers comprises any one or more of a banner, a sign, an advertisement and an image.

19. The lighting system of claim 1, wherein the frame is self-standing.

20. The lighting system of claim 1, wherein the frame a rectangle at least as high as a person.

* * * * *